US005842093A

United States Patent [19]

Tanda

[11] Patent Number: 5,842,093

[45] Date of Patent: Nov. 24, 1998

[54] TONER STORAGE UNIT

[75] Inventor: Tetuo Tanda, Tokyo, Japan

[73] Assignee: Kyocera Corporation, Kyoto, Japan

[21] Appl. No.: 763,418

[22] Filed: Dec. 11, 1996

Related U.S. Application Data

[62] Division of Ser. No. 396,409, Feb. 28, 1995, Pat. No. 5,614,996.

[30] Foreign Application Priority Data

Mar. 3, 1994 [JP] Japan ..... 6-58222
Dec. 29, 1994 [JP] Japan ..... 6-339804

[51] Int. Cl.[6] ..... G03G 15/08

[52] U.S. Cl. ..... 399/263; 399/120; 222/DIG. 1

[58] Field of Search ..... 399/119, 120, 399/260, 262, 263; 222/DIG. 1

[56] References Cited

U.S. PATENT DOCUMENTS

| | | | |
|---|---|---|---|
| 4,841,331 | 6/1989 | Nakayama et al. | 399/281 |
| 4,931,838 | 6/1990 | Ban et al. | 399/106 |
| 4,986,450 | 1/1991 | Yasuda et al. | 222/169 |
| 5,020,697 | 6/1991 | Koiso et al. | 222/DIG. 1 |
| 5,204,720 | 4/1993 | Ishida et al. | 399/256 |
| 5,331,382 | 7/1994 | Miura et al. | 355/260 |

FOREIGN PATENT DOCUMENTS

| | | |
|---|---|---|
| 50-84056 [u] | 7/1975 | Japan . |
| 55-12193 [u] | 3/1980 | Japan . |
| 2-33168 | 2/1990 | Japan . |
| 5-88423 | 4/1993 | Japan . |
| 5-84966 [u] | 11/1993 | Japan . |
| 5-341697 [u] | 12/1993 | Japan . |

*Primary Examiner*—Joan H. Pendegrass
*Attorney, Agent, or Firm*—Loeb & Loeb LLP

[57] ABSTRACT

A toner container comprises a toner storage section for providing a developer unit with a supply of toner, and a residual toner collect section integrally formed with the toner storage section and adapted to collect residual toner after an image has been developed. The present invention is intended to facilitate positioning, loading and unloading of the toner container, and also enable the toner to be smoothly supplied without being scattered from the toner container.

The toner storage section includes a longitudinally extending rotary shaft and a resiliently deformable blade mounted to the rotary shaft. The toner storage section has a bottom, a first side wall, and the other or second side wall. A portion of the blade at a location corresponding to the first side wall is curved larger than a portion of the blade at a location corresponding to the second side wall. Alternatively, a portion of the blade at a location corresponding to the second side wall is curved gradually larger toward a portion of the blade at a location corresponding to the bottom.

The toner storage section has an inclined side wall, and the residual toner collect section has an inclined side wall The side walls of the toner storage section and the residual toner collect section are substantially parallel to the direction in which the toner container is loaded and unloaded.

7 Claims, 21 Drawing Sheets

FIG. 5(A)
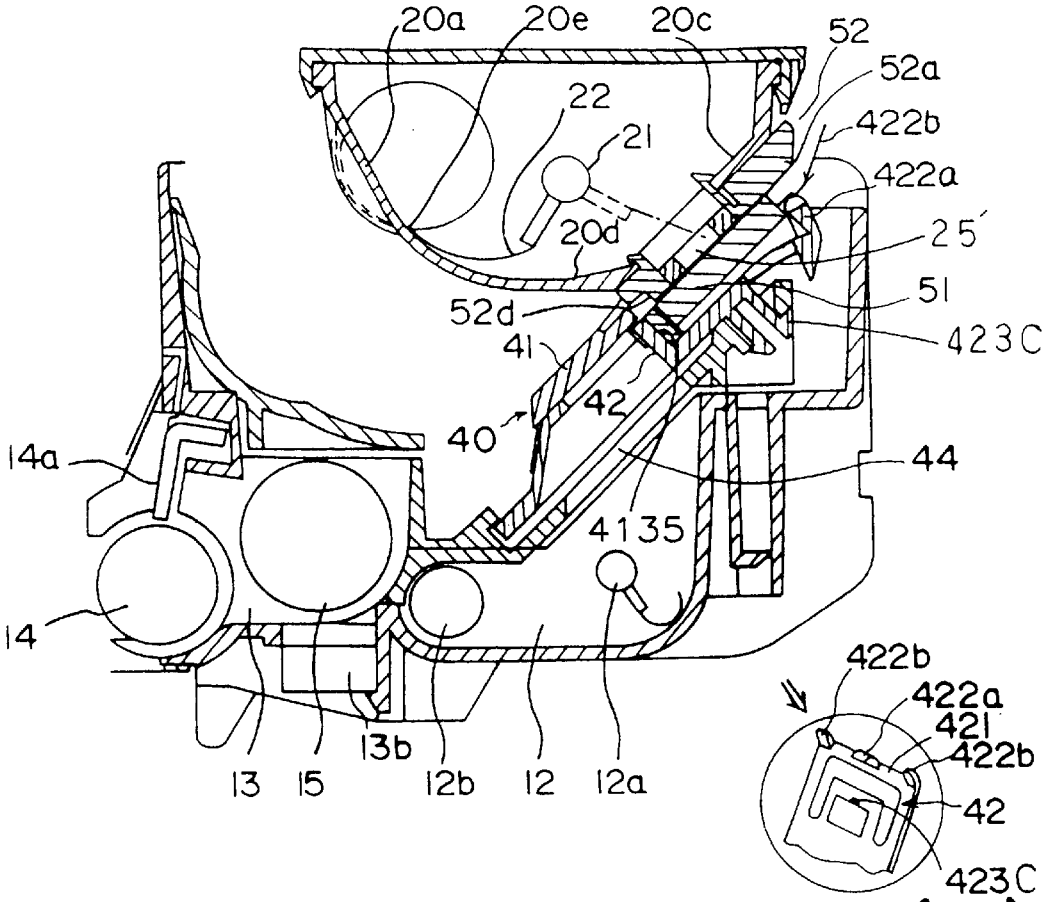
FIG. 5(AA)
FIG. 5(B)
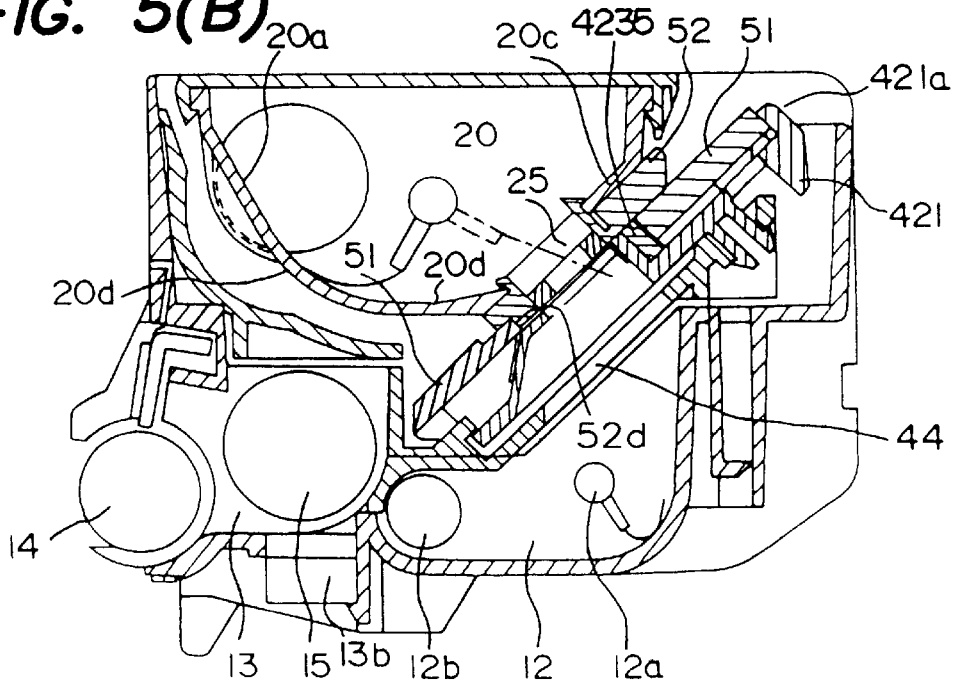

FIG. 20(A)
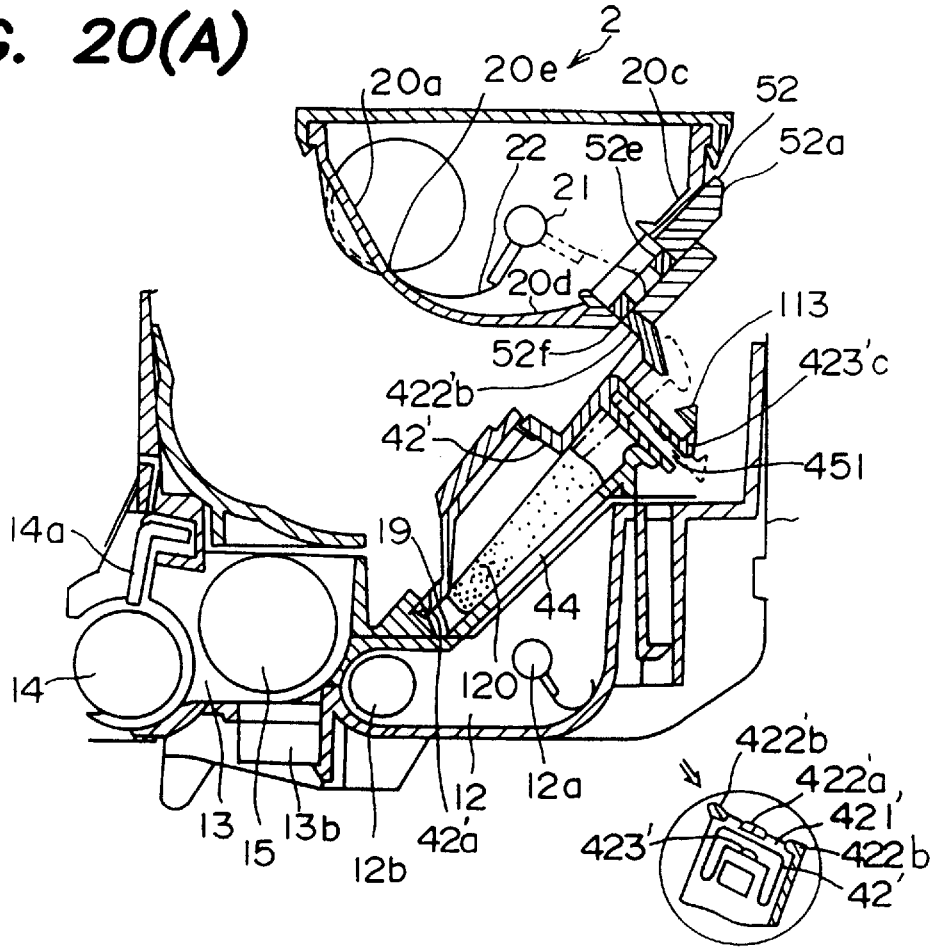
FIG. 20(AA)
FIG. 20(B)
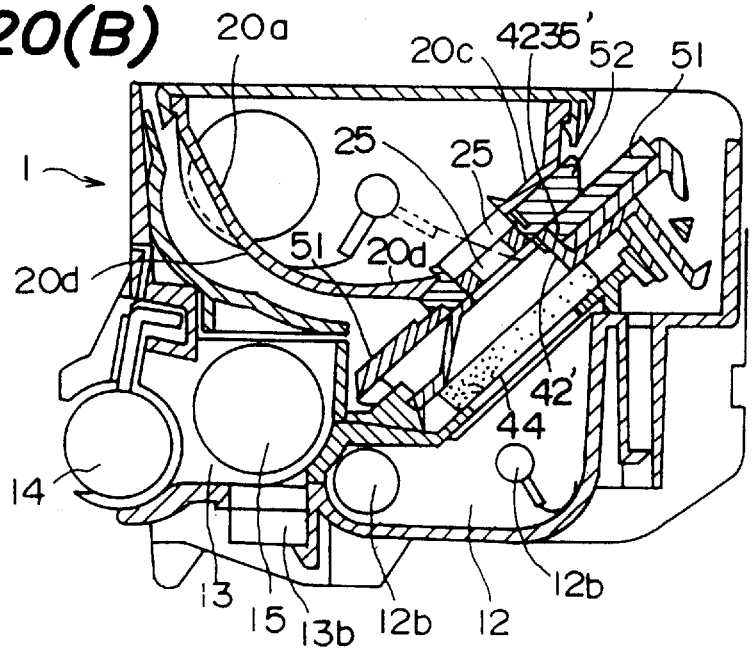

TONER STORAGE UNIT

This is a division of application Ser. No. 08/396,409, filed on Feb. 28, 1995, now U.S. Pat. No. 5,614,996.

BACKGROUND OF THE INVENTION

1. Field of the Invention

The present invention is applicable to a facsimile machine, a printer, a photocopier or a combination of these machines and is directed to an image forming apparatus wherein toner powder is used for image development. More particularly, the present invention relates to a toner storage unit for feeding toner into a developer unit, a residual toner collect unit for collecting residual toner after the image has been developed, a toner container wherein the toner storage unit and the residual toner collect unit are integrated together, and an image forming apparatus including one of these units.

2. Description of the Related Art

An image forming system is conventionally used as a facsimile machine, a printer and a photocopier, and for example, includes an electrophotographic apparatus and an electrostatic recording apparatus as an indirect toner image recording system. These apparatus typically employs a photosensitive drum or belt. A latent image is formed on the photosensitive element by an exposure unit and then, turned to a developed or toner powder image by a developer unit. The toner powder image is thereafter transferred from the photosensitive element to a sheet of recording paper. Also, a direct toner image recording system is well known (see WO 90/14959) and includes a mesh electrode arranged in matrix form and disposed between a toner carrier roller and a back electrode for allowing the passage of a recording paper. A voltage is applied, in a controlled manner, to the mesh electrode corresponding to video or image data so as to attach a toner image to a sheet of recording paper directly from the toner carrier roller.

In such a recording system, for example, the electrophotographic apparatus, a separate toner storage unit provides a toner receptacle in the developer unit with a fresh supply of toner when the toner receptacle becomes empty as a result of consumption of the toner on the photosensitive drum.

More specifically, the toner receptacle in the developer unit has an open top. The toner storage unit has an open bottom which is engageable with the open top of the toner receptacle and sealed by a peelable sheet or a closure member. After the toner storage unit is engaged with the top opening of the toner receptacle, the peelable sheet is peeled off or the closure member is opened so as to dispense the toner from the toner storage unit into the toner receptacle through the open bottom of the toner storage unit and the open top of the toner receptacle.

However, the peelable sheet is subject to damage due to shock in shipment or handling. Also, the open bottom of the toner storage unit is always kept open after the peelable sheet has been peeled away from the open bottom. Thus, residual toner may be scattered from the open bottom of the toner storage unit and may cause soiling within the machine when the toner storage unit is removed from the toner receptacle.

There has been proposed a device wherein shutter members are mounted to the supply opening of the toner storage unit and the opening of a toner receptacle. These openings are opened with the opening of a separate or single shutter member (see Japanese laid-open utility model publication No. 50-84056 and Japanese utility model publication No. 55-12193).

In such a device, toner particles fall into the toner receptacle and are attached to the open edge of the toner receptacle as the shutter members are opened. The toner particles tend to be scatterd from the open edge to cause slight soiling within the machine when the toner storage unit is removed.

The separate shutter member is typically pulled in the longitudinal direction of the toner storage unit. Its operation thus requires a unduly long space.

In order to solve such problems, Japanese laid-open utility model publication No. 5-84966 discloses a toner storage unit which has a shutter member at its bottom and is located adjacent the toner receiving opening of a machine body. When the shutter member of the machine body is pulled (with the shutter member of the toner storage unit being fixed), the toner storage unit or body is so moved as to face with the toner receiving opening of the machine body. This causes toner in its entirety to be drained from the toner storage unit into the machine body.

However, as the toner in its entirety within the toner storage unit falls into the machine body, the machine body must have such a volume as to prevent overflow of the toner. This results in an increase in the size of the machine body.

Where a developer material has two different components, it is necessary to provide a developer unit with a plurality of chambers, that is, a hopper for containing toner and a T/C container for agitating carrier particles and toner particles. If the hopper is adapted to receive the toner in its entirety, there is a substantial difference in quantity between when the hopper is empty and when the hopper is full. This arrangement makes it difficult to control a supply of toner to the T/C container.

Also, discharge of the entire toner at once has a detrimental effect on image development since some of the toner is subject to caking or agglomeration and is drained, in that state, into the hopper.

To overcome such deficiency, the toner storage unit has a side wall extending upwardly from its bottom. An opening is formed in the side wall, and a agitator blade is attached to a rotary shaft which extends along the length of the toner storage unit. The agitator blade is curved from the bottom toward the opening with a predetermined radius of curvature and is rotated to break the agglomerated toner and scrape the toner from the inner wall of the toner receptacle. In this way, the toner is drained from the bottom of the toner storage unit through the opening into the toner receptacle.

The inner wall of the toner receptacle on which the agitator blade is frictionally slid is so arcuated as to provide uniform axial torque. This arrangement, however, results in uniform linear velocity of the agitator blade. It is thus difficult to effectively scrape the toner from the bottom of the toner storage unit up to the opening when the amount of the toner within the toner storage unit decreases, in other words, when the toner is accumulated only in the bottom of the toner storage unit.

To this end, the toner storage unit may have a larger opening. In such a case, however, a substantial amount of toner will be discharged at the initial stage of agitation. It is thus impossible to achieve desired results in this art, that is, gradual supply of toner.

Also, the linear velocity of the agitator blade may be increased as the amount of toner contained within the toner storage unit is decreased. However, this attempt is not appropriate since to increase the linear speed along the entire circumference brings about an increase in axial torque. In addition, the axial torque and the linear velocity are unduly increased at the initial stage of agitation where the toner storage unit has a large amount of toner.

In the electrophotographic apparatus, a cleaning blade is employed to remove residual toner from the photosensitive drum after the toner has been transferred. The residual toner is then directed to a collect container by conveyance means. The collect container is provided at one end of a drum shaft.

In the direct recording system, residual toner is removed from the mesh electrode by an electrostatic, hydraulic or a mechanical cleaning means and is directed to a collect container.

It is necessary to replace the collect container when a predetermined number of copies are produced. However, a indication of required replacement is generally not shown on a display or similar means. There is a risk of overflow as a result of continued production of copies because an operator is not aware of the fact that the collect container is full up with residual toner. As this occurs, the machine suffers from soiling.

In order to overcome this disadvantage, the collect container may have a larger volume, However, such a large collect container substantially affects the design of the machine since the machine has a limited space. It also contradicts the need for a compact machine.

To this end, there have been proposed various devices (see Japanese laid-open patent publication No. 2-33168 and other publications) wherein a toner storage unit and a toner collect container are integrated as a single unit (hereinafter, referred to as a toner container). This arrangement allows replacement of the toner collect container simultaneously or automatically when the toner storage unit is replaced.

One example of such toner container is disclosed, for example, in Japanese laid-open patent publication No. 2-33168. A toner container comprises a cylindrical toner storage unit within which a partition is provided to difine a residual toner collect section at one longitudinal end of a toner reservoir. Another example is disclosed in Japanese laid-open patent publication No. 5-88423. This toner container includes a toner storage unit and a toner collect container with a toner conveyance means, which are integrated by a connecting shaft to form a kit.

However, either of these conventional toner containers is loaded to and unloaded from a machine body in the axial direction of the photosensitive drum or the longitudinal direction of the toner container. A large space is inevitably required for replacement of the toner containers. Particularly, the total length of the toner container is unduly increased since the toner container includes a residual toner collect section at the longitudinal end of the toner reservoir.

In a printer or similar machine where there is no need to provide a document table, it has been proposed that the top of the machine which faces with a document unit can be opened to allow a toner container to be loaded to and unloaded from the top of the machine in the width direction of the toner container, in other words, in a direction at right angles to the axis of the photosenstive drum.

However, this results in a decrease in the width of a guide, as compared to the manner in which the toner container is loaded to the developer unit in the longitudinal direction of the toner container. It is thus impossible to accurately load the container to the developer unit.

The residual toner is not given a uniform charge due to corona discharge or other reasons when an electrostatic latent image is formed, when a bias is applied, or when an image is transferred. As a result, the residual toner is not uniformly accumulated within the toner collect container and tends to be accumulated adjacent the opening of the toner collect container. The residual toner is also subject to crosslinking as it is charged. This results in a decrease in the bulk density of the toner.

As such, even if the toner collect container is designed to become full up with the toner at the time of replacement of the toner container, overflow of the residual toner results prior to the replacement. As this occurs, the machine suffers from soiling.

To prevent uneven accumulation and crosslinking of the residual toner, attemtps have previously been made to provide an agitator blade within a residual toner collect container. However, rotation of the agitator blade within a space wherein residual toner is accumulated results in an increase in the required power. Also, the residual toner, when agitated, is sometimes discharged from the container to outside a residual toner receiving opening.

In view of the foregoing, the inventor of the present application previously proposed an ellipsoidal conveyance roller provided adjacent to the opening of a residual toner collect chamber. Residual toner enters through the opening and is forced toward the residual toner collect chamber as the conveyance roller is rotated (see Japanese utility model application No. 4-29320).

The conveyance roller provides a large force, but can convey only a small amount of residual toner. To this end, an element made of Mylar (TM) is provided to divide the interior of the collect chamber into a preliminary chamber and an accumulation chamber. Residual toner is first drained through the opening into the preliminary chamber. The residual toner is then forced into the accumulation chamber as the conveyance roller is rotated. Even with this arrangement, the residual toner still tends to be accumulated only in the inlet of the accumulation chamber. This results in an increase in useless space of the chamber.

Given the volume of a hopper in a developer unit, it is preferable to gradually add toner contained in the toner storage unit while the toner is agitated by the agitator blade. It is also necessary to provide the residual toner collect chamber with an agitation blade in order to prevent uneven accumulation and crosslinking of the residual toner and insure effective accumulation. In this case, there must be provided an effective seal between the partition and the rotary shaft which extends through the partition. Otherwise, not only the power of the shaft is undesirably increaesd, but also the residual toner enters the collect container.

SUMMARY OF THE INVENTION

An object of the present invention is to provide a toner storage unit wherein an agitator member is adapted to agitate toner so as to smash caky toner, and scrape the toner from the bottom of the unit to feed the toner through a toner supply opening defined in the side wall of the toner storage unit, and to prevent an increase in torque of the shaft and effectively scrape the toner from the bottom toward the toner supply opening even if he toner are accumulated only in the bottom of the toner storage unit.

Still another object of the present invention is to effectively supply toner if the toner storage unit has a small toner supply opening, to provide the shutter members with better seal integrity, and to simplify the toner storage unit.

According to the invention, there is provided to a toner storage unit which comprises a container, a rotary shaft extending longitudinally of the container and an elastically deformable agitator blade attached to the rotary shaft. The agitator blade is curved with a predetermined radius of curvature and adapted to agitate toner while the agitator blade is frictionally slid on the inner surface of a toner storage section.

The present invention is not limited to such a toner cartridge, but may be applied to a hopper or similar means in the developer unit and also, to a toner container wherein the toner storage section is integrally formed with a residual toner collect section, provided that toner is supplied as required.

The present invention is intended to smoothly convey toner from the bottom of the container to the supply opening under the action of the agitator blade without unduly increasing torque of the agitator blade.

To this end, two measures are available.

As a first measure, the force or bias of the agitator blade applied to the inner wall of the container is not constant along the circumference of the container, but is maximized between the bottom and the supply opening. The greater the force of the agitator blade, the greater the friction on the wall of the container. This arrangement enables toner to be scraped toward the supply opening and thus, permits smooth discharge of the toner.

The agitator blade is slid on the upstream or other side wall, but simply in contact therewith to scrape toner from the other side wall and convey the toner to the bottom. The agitator blade is thus required to apply only a small force.

To this end, the rotary shaft has an axis offset toward the toner supply opening.

As a second measure, the transverse section of the container is such that the agitator blade is curved gradually larger toward the bottom.

For example, the container may have an arcuate surface or a combination of an arcuate surface and an inclined surface. Also, the arcuate surface has a nominal center offset from the axis of the rotary shaft toward the other side wall.

With such a means, the force of the agitator blade is maximized in the bottom of the container so as to effectively scrape toner from the bottom and convey the toner toward the supply opening. Thus, the toner acccumulated in the bottom can smoothly and readily be discharged from the supply opening.

Not only the force to scrape the toner, but also the force to agitate the toner is maximized between the bottom and the supply opening. This facilitates longitudinal movement of the toner and allows for smooth agitation of the toner. Also, frictional resistance and torque applied to the distal end of the blade is displaced in the direction of rotation of the blade. If toner exists only in the longitudinal ends of the container, the blade is so rotated as to evenly distribute the toner within the container. If the width of the toner supply opening is less than half, or even one fourth the length of the toner storage section, the toner is discharged without any problem.

A projection extends from the distal end of the blade at a location corresponding to the toner supply opening and is adapted to enter the opening. As the blade is rotated, the projection enters the opening so as to prevent crosslinking of toner in the opening and to allow smooth supply of the toner. Thus, the width of the opening can be less than one eighth to tenth, or even one twentieth to twentyfifth the length of the toner storage section.

Such smaller openings prevent discharge of a substantial amount of toner at the initial stage of agitation. It is also possible to improve seal integrity between the shutter members and the corresponding openings and provide a simple structure.

In either of the measures, the agitator blade is gradually rather than sharply curved and provides a greater force only at any necessay portion of the container. This arrangement prevents undesirable increase in touque.

According to the present invention, the linear speed of the agitator blade increases not with rotational speed, but with accumulation and dissipation of biasing force. In other words, the linear speed is greater at some portion of the blade than the other portion of the blade. This arrangement also prevents undue increase in torque at the initial stage of agitation where a substantial amount of toner is contained within container.

The distal end of the agitator blade has a width less than that of the toner supply opening. As toner is agitated, the distal end of the agitator blade enters the toner supply opening so as to insure supply of the toner through the opening, and prevent caking of the toner in the toner supply opening. If the toner becomes caky across the opening, the distal end of the blade is inserted into the toner supply opening to smash the caky toner and insure supply of the toner.

In order to prevent the generation of toxic gases during incineration, the toner storage unit is made of synthetic resin with calcium carbonate.

As a feature of the present invention, there is provided a toner storage unit which has a bottom and a side wall located downstream of the bottom in the direction of rotation of an agitator blade and including a toner supply opening, the agitator blade being curved larger between the bottom and the toner supply opening than the other side wall in opposite relation to the toner supply opening.

Alternatively, the agitator blade is curved gradually larger from the other side wall to the bottom.

Also, there may be provided a toner storage unit with a combination of these two arrangements.

Preferably, the axis of the agitator blade is offset toward the toner supply opening.

Preferably, The distal end of the agitator blade is shorter than the width of the toner supply opening so that the distal end may enter the toner supply opening when toner is agitated.

The toner storage unit is preferably made of synthetic resin with calcium carbonate.

Also, the toner storage unit is arcuate, or arcuate and inclined from the other side wall to the bottom. The arcuate side wall has a nominal center offset from the axis of the rotary shaft toward the other side wall.

The agitator blade is rotated such that frictional resistance and torque applied to its distal end are displaced in the direction of rotation of the agitator blade. The toner supply opening has a width, in the longitudinal direction of the container, which is less than one half, or preferably, about one fourth the length of the toner storage section. Even with this arrangement, no problem occurs when toner is discharged.

However, the toner could be scattered when the width of the toner supply opening is about one fourth the length of the toner storage section. It is thus preferred that the width of the toner supply opening is less than one eighth to tenth the length of the toner storage section. In such a case, however, the narrower opening may cause crosslinking of toner and deteriorate smooth supply of the toner.

To this end, the projection extends from the distal end of the blade at a location corresponding to the toner supply opening. If the width of the toner supply opening is less than one eighth to tenth, or even less than one twentieth to twentyfifth the length of the toner storage section, the projection enters the opening so as to prevent crosslinking of the toner and promote supply of the toner as the blade is rotated.

This toner storage unit prevents undesirable increase in torque and is effective to scrape toner from the bottom up to the toner supply opening.

Also, according to the present invention, toner can be effectively supplied if the toner supply opening has a small area. It is thus possible to improve seal integrity in the shutter and provide a simple structure.

BRIEF DESCRIPTION OF THE DRAWINGS

FIG. 5(A) shows the toner container immediately before it is loaded to the developer unit;

FIG. 5(B) shows the toner container immediately after it has been loaded to the developer unit;

FIG. 5(AA) is an enlarged view of the structure taken in the direction of 423C in FIG. 5(A).

FIGS. 15(A)–(C) are a detailed views of a gear cover as seen in the direction 15 in FIG. 14(A);

FIG. 15(B)1 is an enlarged view of structure as encircled at G in FIG. 15(A);

FIG. 15(B)2 is an enlarged view of the structure as encircled at H in FIG. 15(A);

FIG. 15(C) shows rear cover;

FIG. 20(A) illustrates the toner container immediately before it is loaded to the developer unit;

FIG. 20(AA) is an enlarged view of the shutter.

FIG. 20(B) illustrates the toner container after it has been loaded to the developer unit;

DETAILED DESCRIPTION OF THE PREFERRED EMBODIMENTS

Figure 2:
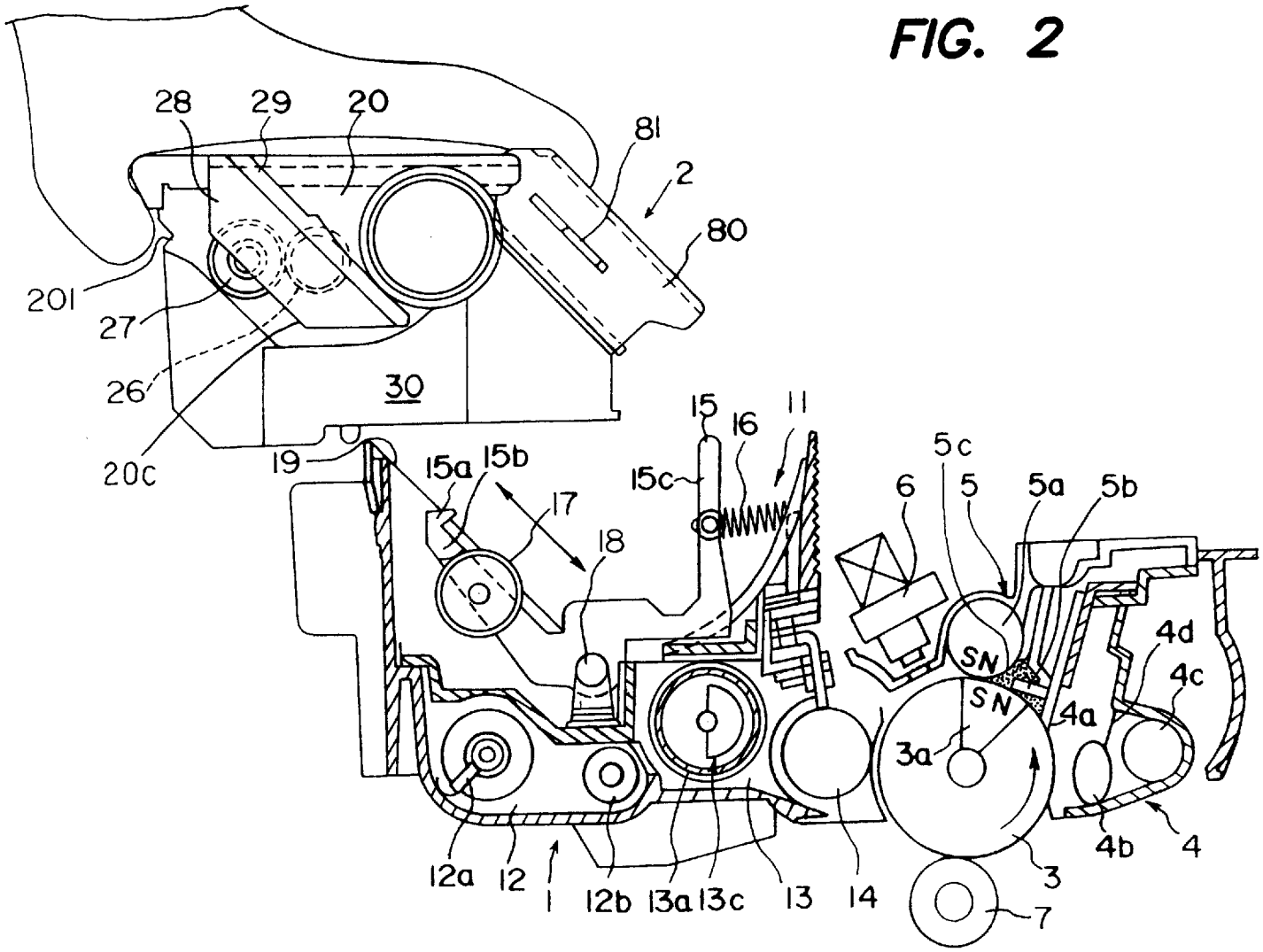
FIG. 2 illustrates the toner container, as seen in the direction 2 in FIGS. 1 and 14(A), before it is loaded to or after it is unloaded from a developer unit, with processing means in a photosensitive drum shown in detail.
Figure 4:
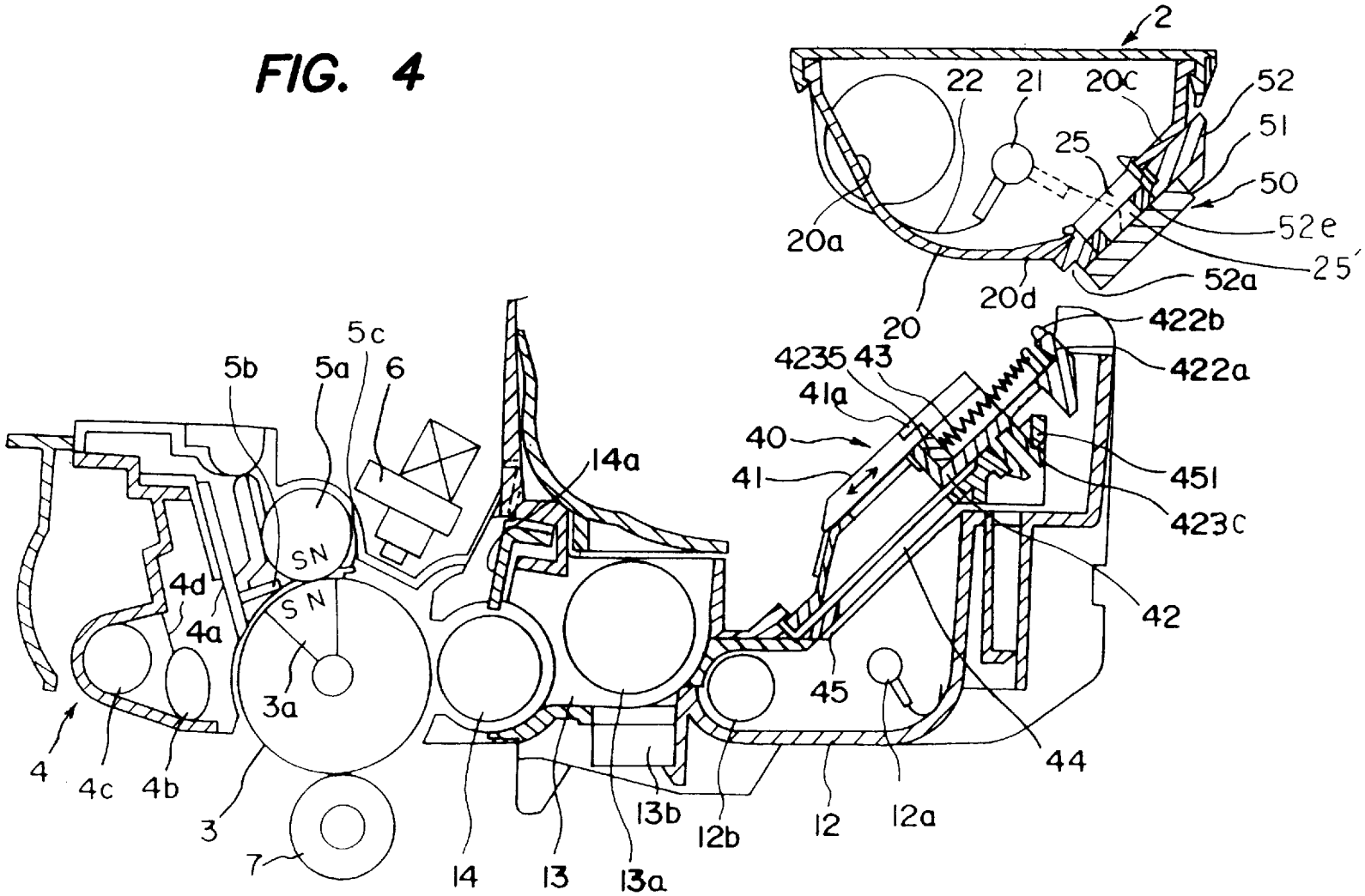
FIG. 4 illustrates the toner container, as seen in the direction 4, before it is loaded to or after it is unloaded from with processing means in the photosensitive drum, a toner storage section and a shutter mechanism in the developer unit shown in detail.

FIGS. 2 and 4 show a developer unit and its related components in an image forming apparatus according to one embodiment of the present invention. Reference numeral 1 indicates a developer unit. 2 is a toner container made of synthetic resin with calcium carbonate and adapted to be removably mounted to a loading station 11 in the direction indicated by the double headed arrow (the width direction of the toner container 2). The loading station 11 is located at the top of the developer unit 1. 3 is a photosensitive drum mounted in a face-to-face relation to a developer sleeve 14 and adapted for rotation in the direction of the arrow. A residual toner collect mechanism 4 with a cleaning blade 4*a*, a charging mechanism 5, a LED unit 6, the developer sleeve 14 and a transfer roller 7 are situated around the photosensitive drum 3 in that order in the direction of rotation of the photosensitive drum 3. The LED unit 6 is adapted to form a latent image on the photosensitive drum 3 corresponding to video data. A toner image is formed by the developer unit 1. The toner image is then tranferred to a sheet of recording paper which is, in turn, fed from a resist roller (not shown) in synchronism with the beginning of the toner image. The toner image is thereafter fused thereto by a fixing roller (not shown). The paper is discharged after a permanent image has been formed.

Processing means, the developer unit 1, the photosensitive drum 3, the residual toner collect mechanism 4, the charging mechanism 5, and the LED unit 6 may be formed as an integral unit.

Reference will now be made to the processing means.

The residual toner collect mechanism 4 is operable to remove residual toner from the photosensitive drum 3 by the cleaning blade 4*a* after the toner image has been transferred.

Figure 1:
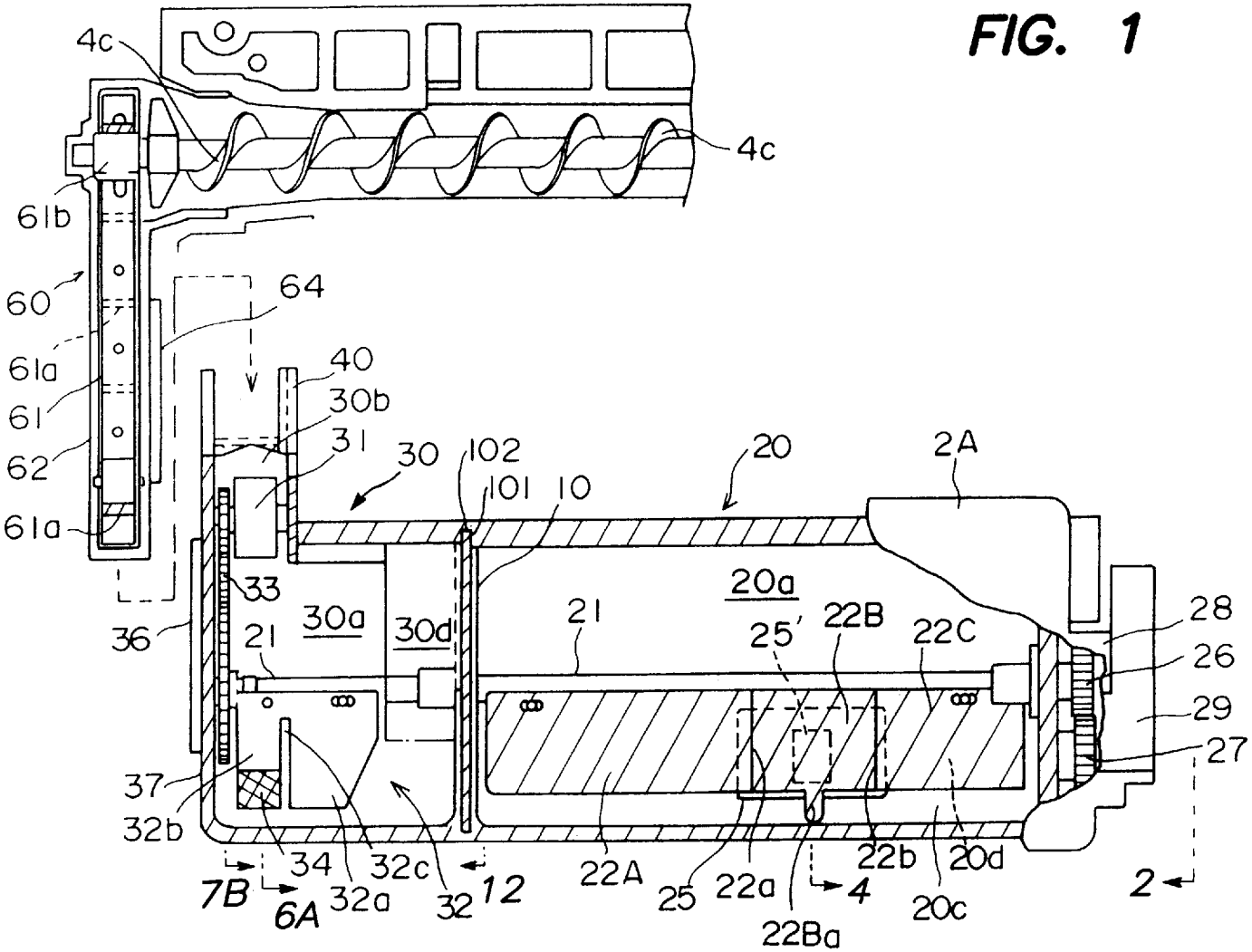
FIG. 1 is a plan view of a toner container and a residual toner conveyance mechanism, according to a first embodiment of the present invention.
Figure 6A:
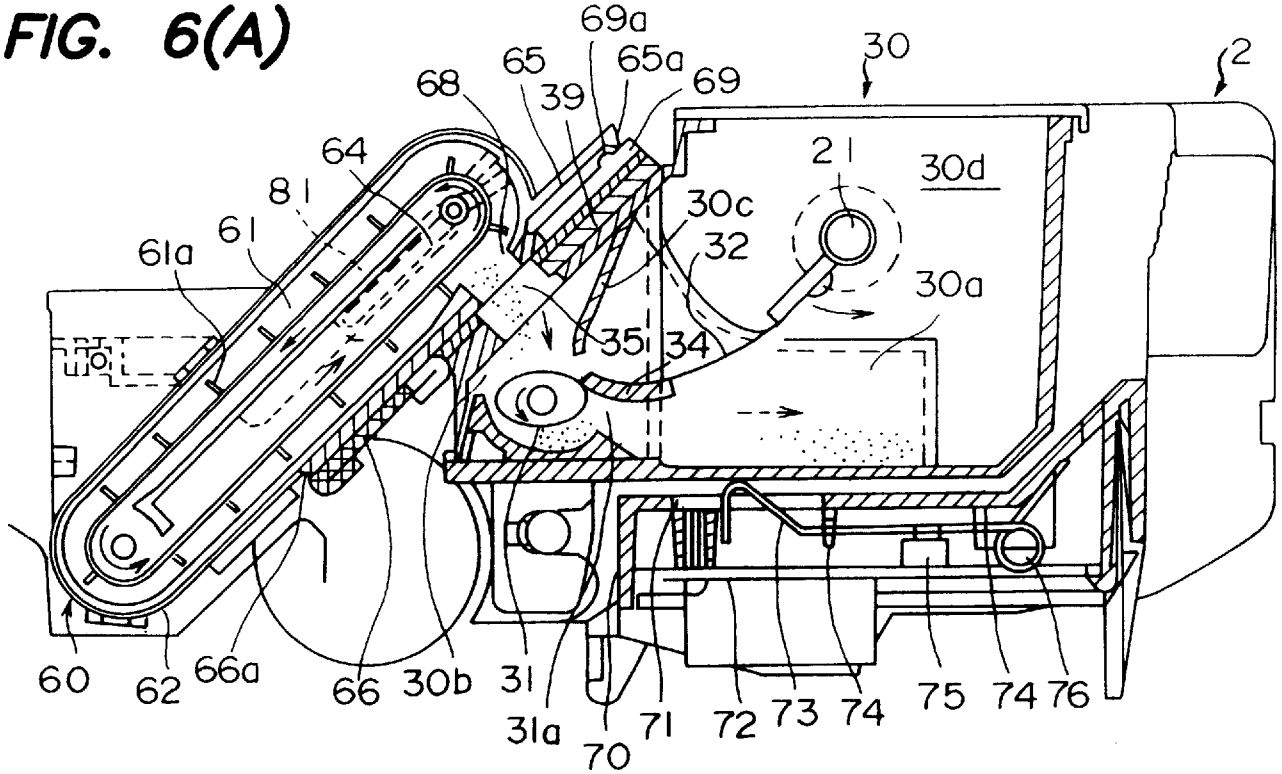
FIG. 6(A) is a sectional view taken along the line 6A in FIGS. 1 and 14(A), showing a belt conveyor machanism mounted to a residual toner collect section.
Figure 6B:
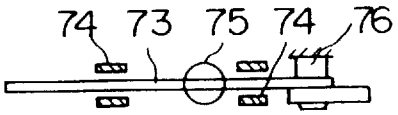
FIG. 6(B) is a bottom view of a wire spring shown in FIG. 6(A)

The residual toner thus removed is sent to a collect chamber by an ellipsoidal roller 4*b* with its top sealed by an element made of Mylar 4*d*. The residual toner is then sent to a belt conveyor mechanism 60 by a screw roller 4*c* shown in FIG. 1. As shown in FIGS. 1 and 6(A), the belt conveyor mechanism 60 includes an upwardly inclined oblong belt housing 62 within which an endless rubber belt 61 is rotated in the direction of the arrow. A plurality of partitions 61*a* extend upwardly from the surface of the endless belt 61 and are spaced a suitable distance away from each other. The residual toner is conveyed to the bottom of the belt housing 62 by the screw roller 4*c*. As the endless belt 61 is rotated, the residual toner between each adjacent partitions 61*a* is conveyed to a top or discharge opening 68. The residual toner then enters the residual toner collect section 30 through a collect opening 35 which is formed in a face-to-face relation to the discharge opening 68.

The residual toner collect section 30 is defined within the toner container 2 by a partition wall 10 adjacent to one longitudinal end of the toner container 2. The toner container 2 is made of a low pollution resin as will be explained later. The shape and internal structure of the residual toner collect section 30 will be described later.

As shown in FIG. 2, the charging mechanism 5 comprises a magnet roller 5*a*, a charging plate 5*b* made of a magnetic material, a group of charged particles 5*c* located on and around the magnet roller 5*a* and the charging plate 5*b*, and a back electrode 3*a* provided at the back of the photosensitive drum 3. The back electrode 3*a* is effective to apply a charging bias through the group of charged particles so as to give a uniform charge on the photosensitive drum 3.

As is well known, the LED unit 6 comprises a LED head array for controlling an array of LED elements to emit light in response to video or image data, and a lens adapted to focus the light from the LED head array.

A developer material or agent is contained in the developer unit 1 and includes two different components, that is, carrier and toner (hereinafter referred to as T/C). The developer unit 1 comprises a T/C receptacle 13 for generating charges on the toner, and a hopper 12 through which the toner is fed to the T/C receptacle 13 as necessary. The loading station 11 is formed above the T/C receptacle 13 and the hopper 12 to mount the toner container 2 which is adapted to provide the hopper 12 with a fresh supply of toner.

Situated within the T/C receptacle 13 are a developer sleeve 14 with a fixed magnet assembly (not shown), an agitator roller 13*a* for uniformly mixing the toner and carrier particles together. The agitator roller 13*a* includes a magnet roller 13*c* rotated concentrically within a nonmagnetic sleeve.

The hopper 12 comprises an agitator roller 12*a* associated with an element made of Mylar (TM), and a toner supply roller 12*b* adapted to receive toner information from a toner sensor and feed toner through a toner supply opening 12*c* to the T/C receptacle 13 as the toner within the T/C receptacle 13 is depleted.

The loading station 11 is provided with a toner container loading mechanism and a shutter mechanism associated with the hopper 12.

The toner container 2 is made of a low pollution resin with calcium carbonate. As shown in FIG. 1, the toner container 2 comprises a toner storage section 20 extending longitudinally of the toner container 2 and the residual toner collect section 30 defined in the longitudinal end of the toner container by means of the partition wall 10.

Reference will now be made to the structure of the toner storage section 20.

FIGS. 4 and 5(A) and 5(B) show the toner storage section 20 as seen from the rear in FIG. 2. As shown in transverse section in FIGS. 4 and 5(A) and 5(B), the toner storage section 20 has a central bottom 20*d*, a top, a first side wall depending from the edge of the top and inclined inwardly along a straight line, and a rectangular toner supply opening 25 formed at a location adjacent to the first side wall 20*c* and slightly above the central bottom 20*d*.

A second or opposite side wall 20*a* is inclined at an angle slightly sharper than that of the first side wall 20*c* and terminates at the central bottom 20*d*. The lower end of the second side wall 20*a* has an arcuate transverse section 20*e*.

As shown in FIG. 1, a rotary shaft 21 extends along the length of the toner storage section 20 and projects into the residual toner collect section 30 through the partition wall 10. The rotary shaft 21 has opposite ends journaled in opposite walls of the toner container. A radial blade 22 extends throughout the length of the toner storage section 20. The radial blade 22 is made of Mylar (TM) and elastically deformed in the direction of rotation of the blade. The radial length of the blade 22 is so determined as to be in sliding contact with the inner wall of the toner storage section 20.

As shown in FIG. 4, the rotary shaft 21 is mounted such that its central axis is offset from the center of the toner container 2 slightly toward the toner supply opening 25. The lower end of the second side wall 20*a* is located slightly below the nominal horizontal central line of the toner container such that the blade 22 is curved gradually larger toward the bottom 20*d*.

Reference numerals 22*a* and 22*b* (FIG. 1) indicate cutting lines formed in three agitator blades 22A, 22B and 22C and associated with the toner supply opening 25. A tongue 22B*a* extends from one end of the agitator blade 22B at a location corresponding to the toner supply opening 25 and has a width narrower than that of an opening 25'. The opening 25' is defined by an opening restriction member 52*e* which is, in turn, mounted within the toner supply opening 25.

As shown in FIG. 1, the toner supply opening 25 is defined generally centrally in the first side wall 20*c*, but displaced slightly toward one end of the toner storage section 20. The width of the toner supply opening 25 is approximately one fourth of the total length of the toner storage section 20. The opening 25' has a width (3 to 5 mm) approximately one fiftieth shorter than that of the toner storage section 20.

The rotary shaft 21 has one end which extends outwardly through one end of the toner storage section 20. A gear 26 is mounted to the one end of the rotary shaft 21. When the toner container 2 is mounted to the loading station 11 of the developer unit 1, a rotational force is transmitted to the gear 26 through a gear 27. As shown in FIG. 5(B), the blade is rotated from the bottom 20*d* toward the toner supply opening 25 so as to feed toner to the hopper 12 of the developer unit 1 through the openings 25 and 25' and a toner receiving opening 44.

The toner drained into the hopper 12 is agitated by an agitator roller 12*a*. The T/C receptacle 13 is provided with a toner sensor 13*b* to detect the amount of toner within the T/C receptacle 13. As the toner within the T/C receptacle 13 is reduced, the toner supply roller 12*b* is so rotated as to dispense the toner through the toner supply opening 12*c* (FIG. 2) into the T/C receptacle 13 or maintain the toner amount or level within the T/C receptacle 13.

It is necessary to rapidly dispense the toner from the toner storage section 20 into the hopper 12. To this end, a drive system in the machine body is advantageously employed to continuously rotate the agitator blade 22.

In order to prevent inadvertent contact of the gears 26 and 27 with other components and resulting damage during loading of the toner container, a protection cover 28 is integrally formed with a cap 2A made of synthetic resin with calcium carbonate, as shown in FIG. 1. If necessary, a guide rib 29 is formed in the outer wall of the protection cover 28 and extends parallel to the first side wall 20*c* of the toner container. On loading of the toner container 2, the guide rib 29 is fit in a guide groove (not shown) in the machine body.

The width of the opening 25' in the direction of the toner container is less than one twentyfifth, preferably one fiftieth (3 to 5 mm) of the total length of the toner storage section 20 as mentioned earlier.

The opening 25' is smaller than the toner supply opening 25 so as to allow toner to be gradually fed into the hopper 12. When the hopper is full up with the toner, the toner is freely rotated within the container. Thus, a drive mechanism within the hopper is in no way locked which may otherwise occur when the toner is squeezed into the hopper.

The toner storage section 20 has a asymmetrical transeverse cross section, and the rotary shaft 21 is offset from the center of the toner storage section 20. This arrangement allows friction and torque at the end of the blade 22 to be displaced in the direction of rotation of the blade. If the toner is undesirably displaced toward opposite ends of the toner storage section while the blade 22 is rotated, the toner is uniformly dispensed from the toner supply opening 25'.

Also, in the illustrated embodiment, the blade 22 is curved gradually larger from the second side wall 20*a* toward the bottom 20*d* of the toner storage section 20, and the force of the blade 22 is maximized at the bottom 20*d*. By this arrangement, toner present in the bottom 20*d* can effectively be scraped so as to facilitate discharge of the toner through the toner supply opening 25.

After the toner in the bottom 20*d* has been discharged, a fresh supply of toner is added from opposite longitudinal sides.

Since the agitator blade 22 is curved greater in the first side wall 20*c* than in the second side wall 20*a*, toner is more strongly scraped and agitated in a portion of the toner storage section from the bottom 20*d* to the toner supply opening 25. This facilitates longitudinal movement of the toner toward the toner supply opening 25 and promotes smooth agitation.

If only a small amount of toner remains within the toner storage section 20, the agitator blade 22 is repeatedly rotated to gradually dispense the remaining toner through the opening 25'. The toner is then moved to the toner opening supply 25 and in no way left in the longitudinal ends of the container. In this way, substantially the entire toner can be drained into the hopper 12.

The opening 25' has a narrow width. This may result in agglomerating or caking of the toner across the opening 25'. Advantageously, the projection or tongue 22B*a* of the agitator blade 22 is inserted into the opening 25' during rotation of the blade so as to brake or smash the caky toner and promote supply of the toner.

Again, in this embodiment, the tongue 22B*a* extends from the front end of the blade at a location corresponding to the opening 25' and is adapted for insertion into the opening 25'. It is thus possible to inhibit crosslinking of the toner and allow for smooth supply of the toner if the opening 25' has a width one twentieth or even one twentyfifth less than that of the toner storage section.

Figure 24:
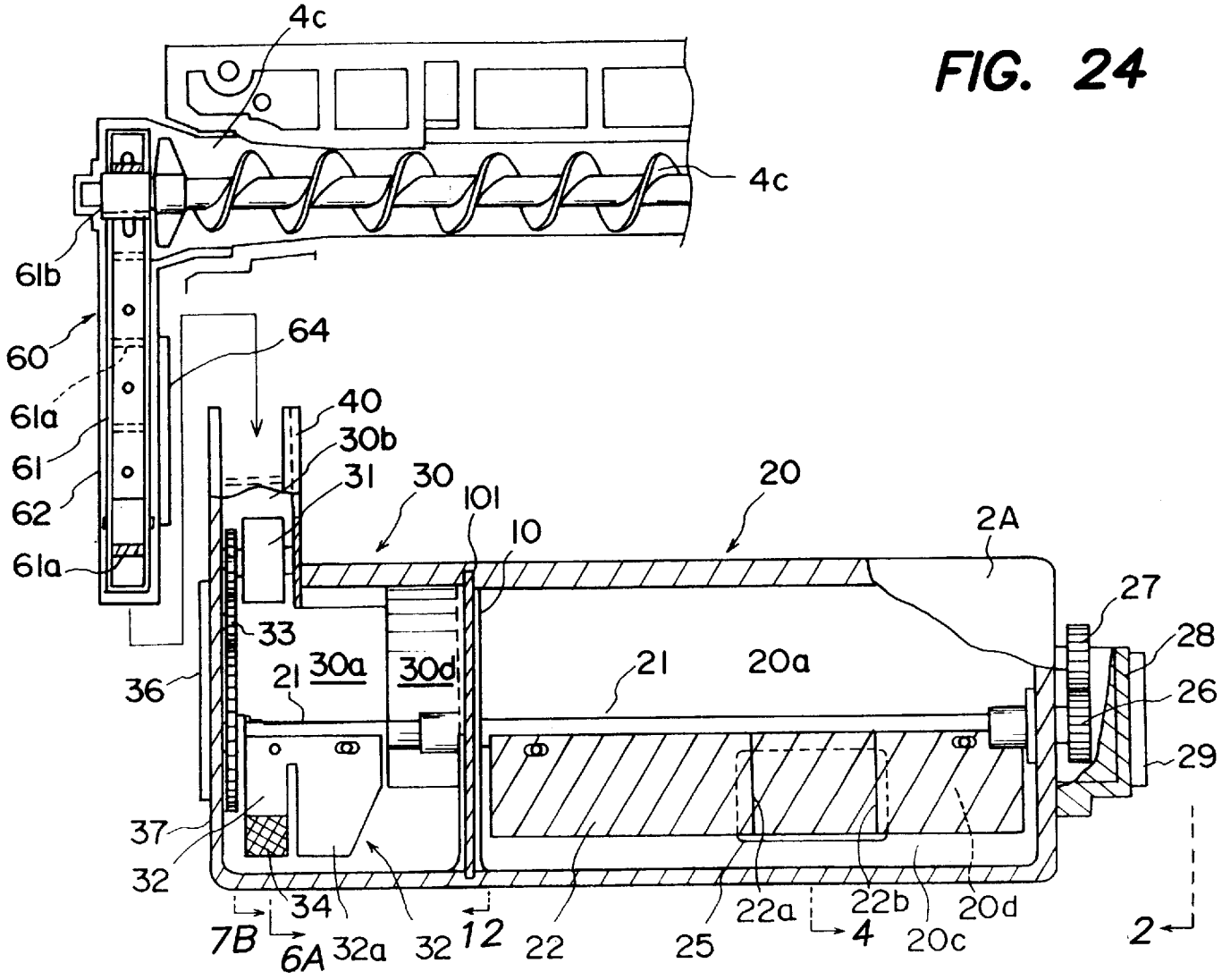
FIG. 24 is a plan view of a toner container and a residual toner conveyance mechanism according to another embodiment of the present invention.

Also, as shown in FIG. 24, toner can smoothly be discharged without the aid of the tongue 22B*a* if the width of the toner supply opening 25' is one half or preferably one fourth shorter than the length of the toner storage section 20. This is due to the fact that friction and torque vary from one end of the blade in the direction of rotation of the blade 22 as the blade is rotated.

Reference will next be made to the configuration of the residual toner collect section 30.

As shown in FIGS. 1 and 6(A), the residual toner collect section 30 is deeper than the toner storage section 20 and has a substantially rectangular section. The residual toner collect section 30 has a trapezoidal chamber 30*b* defined at one longitudinal end of the second side wall 20*a* of the toner storage section opposite the toner supply opening 25. The trapezoidal chamber 30*b* has an inclined top or surface 39 which extends obliquely and downwardly from the upper end toward the lower end of the chamber. The inclined surface 39 extends parallel to the first side wall 20*c* of the toner storage section 20 and has a collect opening 35.

Figure 7A:
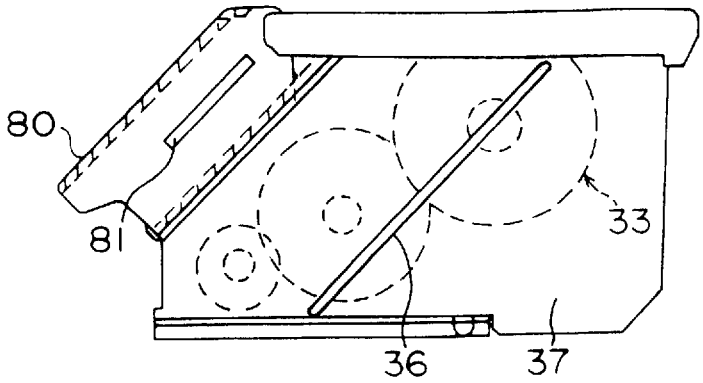
FIG. 7(A) is a side view showing one longitudinal end of the residual toner collect section.
Figure 7B:
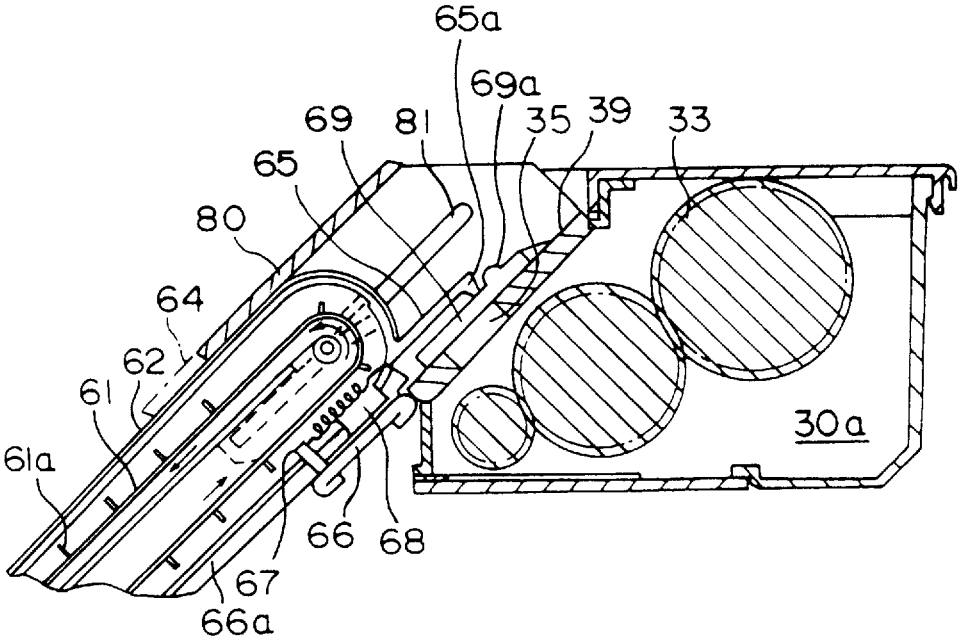
FIG. 7(B) is a sectional view taken along the line 7B showing the residual toner collect section before the belt conveyor mechanism is mounted thereto.

As shown in FIGS. 2 and 7(A) and (B), a guide member 80 is mounted above the collect opening 35 to receive the belt conveyor mechanism. A slit 81 is formed in one side of the guide member 80 and extends parallel to the inclined surface 39. A guide rib extends from one side of a belt housing and is fit into the slit 81. In FIG. 7(B), the guide member 80 and the belt housing 62 are shown on an enlarged scale for the purpose of clarity.

As shown in FIGS. 1 and 6(A), a toner accumulation chamber 30*d* is defined in a stepwise fashion adjacent to the partition wall 10.

A conveyance roller 31 is located within the trapezoidal chamber 30*b* below the collect opening 35. The conveyance roller 31 has an ellipsoidal shape on section view and is made of rigid resin. A partition wall 30*c* depends from the top of the trapezoidal chamber 30*b* and terminates adjacent to the bottom of the trapezoidal chamber 30*b* to form an opening 31*a* through which the trapezoidal chamber 30*b* and the collect chamber 30*a* are communicated with each other.

A radial blade 32 is mounted to the rotary shaft 21 which extends through the collect chamber 30*a*. The blade 32 is elastically deformed in its rotational direction.

The blade 32 is absent from a portion of the rotary shaft 21 within the toner accumulation space adjacent to the partition wall 10, but outside of the lower region of the collect opening 21 of the residual toner collect section 30. The blade 32 is frictionally slid only within, say, the rectangular space.

The blade 32 comprises a narrow portion 32*b* at a location corresponding to the trapezoidal chamber 30*b*, and a wide portion 32*a* with one end cut out. A slit is formed between the narrow portion 32*b* and the wide portion 32*a* of the blade. The narrow blade portion 32*b* has a free end in sliding contact with the peripheral surface of the conveyance roller 31 adjacent to the opening 31*a*. A thin layer 34 is attached to the free end of the narrow blade portion 32*b* and made of a material, such as sponge, having a coefficient of friction greater than that of the blade. The sponge layer 34 is frictionally contacted with the peripheral surface of the ellipsoidal roller 31 to positively remove toner from the roller 31 and also, feed toner from adjacent the opening to the collect chamber 30*a*.

The residual toner fed to the collect chamber 30*a* is agitated by the wide blade portion 32*a* and then, enters the accumulation chamber 30*d*.

As no blade exists within the accumulation chamber 30*d*, no agitation takes place, and the residual toner can be accumulated with high density.

Figure 12:
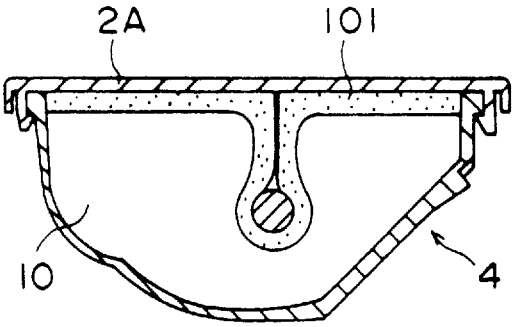
FIG. 12 is a sectional view taken along the line 12 of FIG. 1, showing a partition wall.

A groove 102 is formed in the top of the partition wall 10. As shown in FIGS. 1 and 12, a seal string or member 101 is Lade from sponge and fit in the groove 102 to provide a seal between the cap 2A and the partition wall 10. A portion of the groove in the form of a tongue terminates at a portion of the partition wall through which the rotary shaft 21 extends. The seal member 101 has a U-shaped central portion fit in that portion of the groove 102 and adapted to seal the rotary shaft 21 against the partition wall 10.

A gear train 33 is mounted to the inner wall of the collect chamber 30*a* adjacent to one end of the rotary shaft 21 and adapted to connect the rotary shaft 21 with the conveyance roller.

The gear train 33 comprises a speed increasing gears and is designed such that the speed of rotation of the blade 32 is less than the speed of rotation of the conveyance roller 31.

Figure 11A:
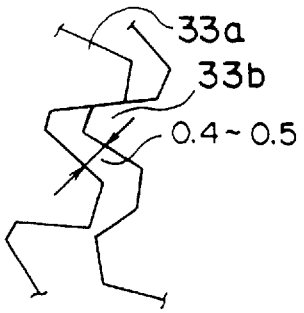
FIG. 11(A) illustrates the profile of a gear mounted to a rotary shaft in the residual toner collect section and the profile of a gear in a conveyance roller, according to the present invention.
Figure 11B:
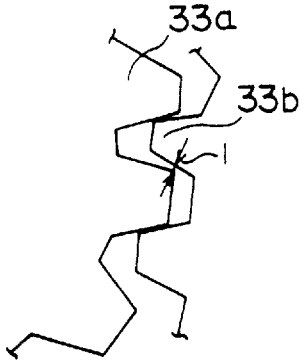
FIG. 11(B) is a view similar to FIG. 11(A), but showing the profile of each of conventional gears.

As shown in FIGS. 11(B), adjacent gears 33*a* and 33*b* in the gear train 33 are different in profile from each other. As shown in FIG. 11(A), each tooth of the gear 33*a* is wider in tooth width (narrower tooth root) than each tooth of the other gear 33*b* so that the gears engaged with big backlash are meshed with lost motion or play.

Where a gear has a diameter, for example, of 30 Φ, the clearance between the tooth of one gear and the tooth of the other gear is normally on the order of 0.1 mm (see FIG. 11(B),) but in the range of 0.4 to 0.5 mm in this embodiment.

Referring to FIG. 1, reference numeral 36 indicates a position restriction rib which extends parallel to the first or inclined side wall 20*c* of the toner storage section 20 in which the toner supply opening 25 is defined. The rib 36 is releasably fit in a groove (not shown) formed in the machine body.

In the illustrated embodiment, the gear train 33 is internally mounted to the end wall of the residual toner collect section 30. This arrangement eliminates the risk of contact of the gear train 33 with the guide or other elements in the machine body. In addition, the adjacent gears 33*a* and 33*b* have different profiles. Thus, if toner is accidentally introduced between the gears, the toner is removed as the gears are rotated. No locking results.

Reference will now be made to a mechanism for mounting the toner container 2, and shutter members.

Figure 3A:
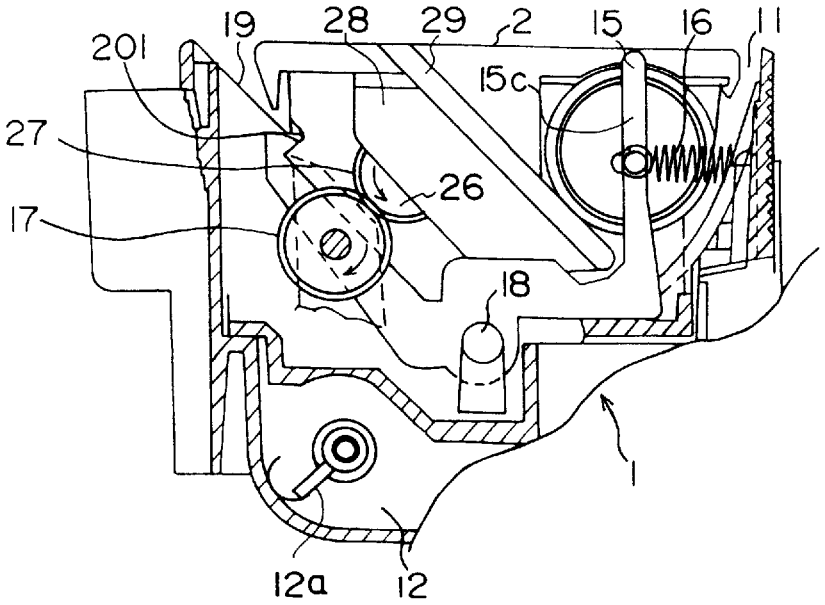
FIG. 3(A) shows the toner container loaded to the developer unit.
Figure 3B:
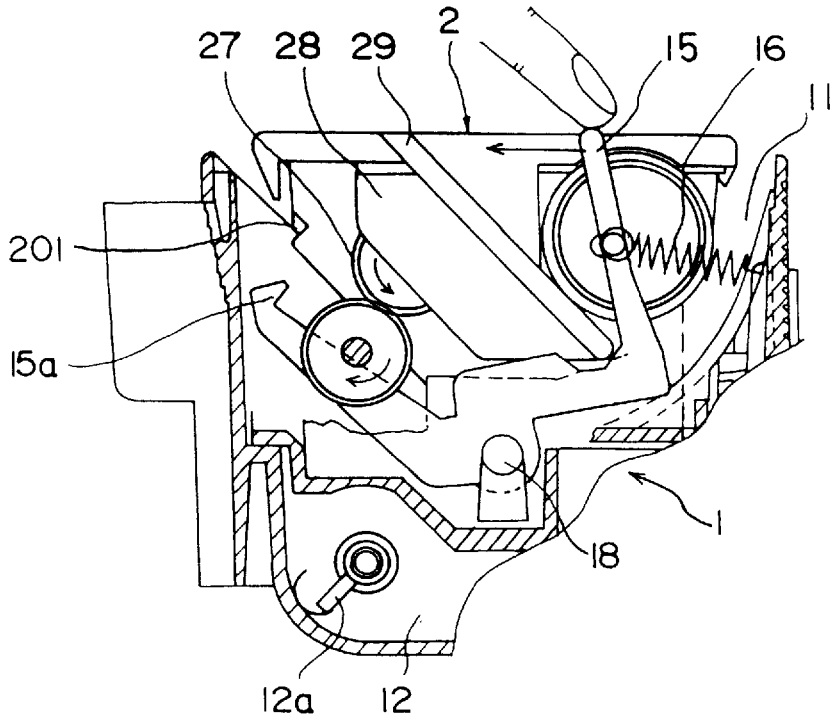
FIG. 3(B) shows the toner container immediately before it is removed from the developer unit.

As shown in FIGS. 3(A) and 3(B), the loading station 11 on the top of the developer unit 1 includes a lock/release lever 15 adapted to hold the toner container 2 in position and allow removal of the toner container 2 and pivotably supported by a pivot shaft 18.

The member 15 comprises a lock lever 15*b* extending obliquely and upwardly from the pivot shaft 18 along an inclined surface 19 of the unit and having a pawl 15*a* at its free end, and a swing or control lever 15*c* extending from the pivot shaft and having a L-shape.

As shown in FIG. 7(B), the rectangular prismatic guide member 80 is mounted onto the inclined surface 39 of the residual toner collect section 30 where the residual toner receiving opening 35 is formed. The guide member 80 has an internal shape identical to the cross sectional shape of the belt housing 62 of the machine body. The guide member 81 has a slit 61 which extends parallel to the inclined surface 39. A shutter plate 69 is movable on the inclined surface 39 by a restriction guide, not shown, so as to open and close the residual toner receiving opening 35. The shutter plate 69 has a projection 69*a* on its upper surface.

As shown in FIGS. 6(A) and 7(B), a residual toner conveyance mechanism includes a shutter member 66 adapted to open and close the discharge opening 68 of the belt housing 62 and attached to the belt housing through a sponge layer 66*a*. A spring 67 is disposed to pull the shutter member 66 to allow the shutter member 66 to close the discharge opening 68. A plate member 65 extends from the upper end of the belt housing and is elastically swingable away from the shutter plate 69. A pawl 65*a* is formed on the front or free end of the plate member 65 and is engageable with the projection 69*a* of the shutter plate 69 so as to open and close the toner receiving opening 35.

By this arrangement, the toner container 2 is loaded to the developer unit 1 while the inclined surface 19 of the developer unit 1 is aligned with the first or inclined side surface 20*c* of the toner container as shown in FIG. 2. At this time, the guide member 80 is first fitted over the belt housing 62 (see FIG. 7(B)). The pawl 65*a* of the belt housing 62 is engaged with the projection 69*a* of the shutter plate 69 and is adapted to push up the shutter plate 69 so as to open the toner receiving opening 35. At this time, the lower end of the residual toner collect section 30 is brought into engagement with the upper edge of the shutter member 66 to lower the shutter member 66 against the action of the spring 67 and thus, open the discharge opening 68. The pawl 65*a* of the belt housing is stopped when it is moved beyond the projection 69*a* of the shutter plate 69.

The shutter plate 69 is held in position by the upper end of the sponge layer 66*a* upon engagement of the pawl 65*a*.

The shutter member in the toner storage section is also opened when the toner container 2 is loaded to the developer unit 1 with the inclined surface 19 aligned with the inclined surface 20*c* of the toner container 2. This arrangement will be described later.

Referring to FIG. 2, when the inclined surface 20*c* of the toner container 2 is moved obliquely and downwardly toward the inclined surface 19 of the developer unit, the pawl 15*a* of the lock lever 15*b* is first brought into contact with the toner container 2. As a result, the lever 15 is moved away from the inclined surface 19 against the action of the spring 16. When the toner container 2 is loaded to a predetermined position, the pawl 15*a* of the lock lever 15*b* is brought into engagement with a recess 201 of the toner storage section 20.

The toner container 2 is held in position under the action of the spring 16. However, the force of the spring is not sufficient to positively fix the toner container 2 in position.

To this end, a spring 43 is associated with a shutter member 40 in the developer unit 1 and is advantageously employed to hold the toner container in position.

Referring specifically to FIG. 4, the spring 43 is connected to the shutter member 40 and is adapted to urge the shutter member 40 in such a direction as to close a toner receiving opening 44 prior to the loading of the toner container 2. As such, the bias of the spring 43 is maximized when the toner receiving opening 44 is open. Turning to FIG. 2, the pawl 15*a* of the lock lever is engaged with the recess from below, in other words, in a direction against the bias of the spring 43. This arrangement insures accurate positioning and holding of the toner container 2 in position.

Again, the spring 16 and the spring 43 of the shutter member 40 advantageously apply opposite pulling forces. The spring of the shutter member urges the shutter member in such a direction as to close the toner receiving opening and provides a maximum amount of force when the shutter is opened during loading of the toner container. In this way, the toner container 2 can positively be held in position.

When the toner container 3 is finally held in position as shown in FIG. 3(B), the gear 27 of the toner container 2 is brought into meshing engagement with the drive gear 17 of the developer unit. The bottom of the residual toner collect section 30 pushes down the wire spring 73 which then, projects upwardly from a slit 71. This slit 71 is formed in a loading table 70 of the developer unit as shown in FIG. 6(A). A sensor 75 is fixedly mounted to a base plate 72 and is pressed down as the wire spring 73 is pushed. The sensor 75 is operable to sense that the toner container is accurately loaded and send a corresponding signal to a control circuit (not shown).

The wire spring 73 tends to be laterally swung since it is supported only by a shaft 76. To this end, a pair of projections 74 depend from the lower surface of the loading table 70 on either side of the wire spring 73 so as to prevent the lateral swing motion of the wire spring 73 and insure pressing of the sensor.

To remove the toner container 2, the control lever 15*c* is rotated in a counterclockwise direction so as to disengage the pawl 15*a* from the recess 201 as shown in FIG. 3(B). The toner container 2 is then automatically moved upwardly along the inclined surface under the action of the spring 43 (see FIG. 4).

The recess 201 has a surface which faces against the direction of bias of the spring 43, that is, which extends in a direction at right angles to the inclined surface 19.

Referring to FIG. 6(A), as the toner container is raised, the shutter plate 69 is lowered to close the toner receiving opening 35. This is because the pawl 65*a* of the belt housing 62 is engaged with the projection 69*a* of the shutter plate 69. At the same time, the shutter member 66 in the belt housing 62 is moved under the influence of the spring 67(B) (FIG. 7) so as to close the discharge opening 68. The toner container 2 can be removed with both the discharge opening 38 in the belt housing 62 and the toner receiving opening 35 in the residual toner collect section 30 closed by the respective shutter members.

The shutter mechanism in the toner storage section 20 will next be described with reference to FIGS. 2, 4 and 5(A) and (B).

The loading station 11 on the developer unit 1 is formed with the inclined surface 19 which extends parallel to the first or inclined surface 20*c* of the residual toner collect section 30. The toner receiving opening 44 is defined in the inclined surface 19 at a location corresponding to the hopper 12 (FIG. 4). The shutter members 40 and 50 are mounted to the inclined surface 20*c* in the toner container and the toner receiving opening 44 in the developer unit 1, respectively.

The shutter member 50 is made of elastically deformable resin and comprises a shutter mounting plate 52 attached to the inclined surface 20*c* and having the toner supply opening 25, and a shutter plate 51 movable along a restriction guide 58 in the transverse direction of a cartridge for opening and closing of the toner supply opening 25. The structure of the shutter plate and the shutter mounting plate will be described hereinbelow.

Figure 8A:
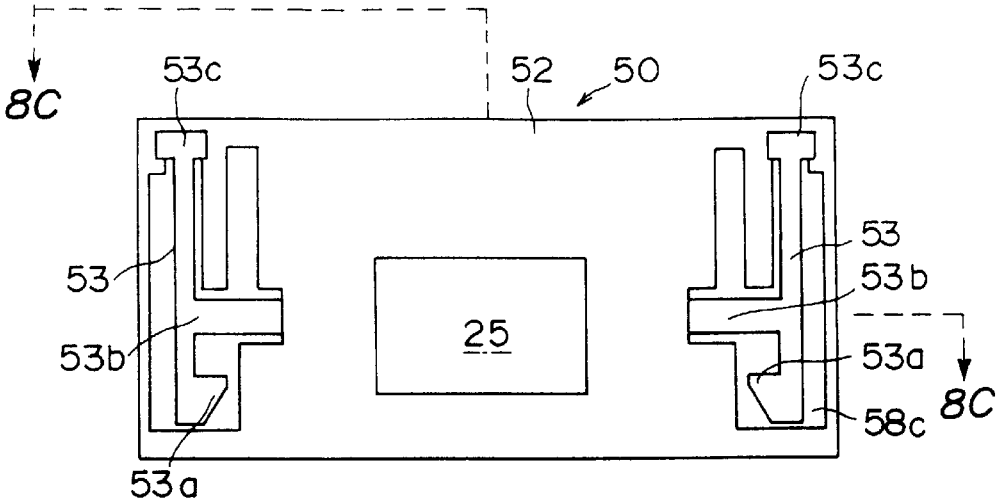
FIG. 8(A) is a top plan view of a shutter member 50 adapted to open and close a toner supply opening formed in the toner storage section.
Figure 8B:
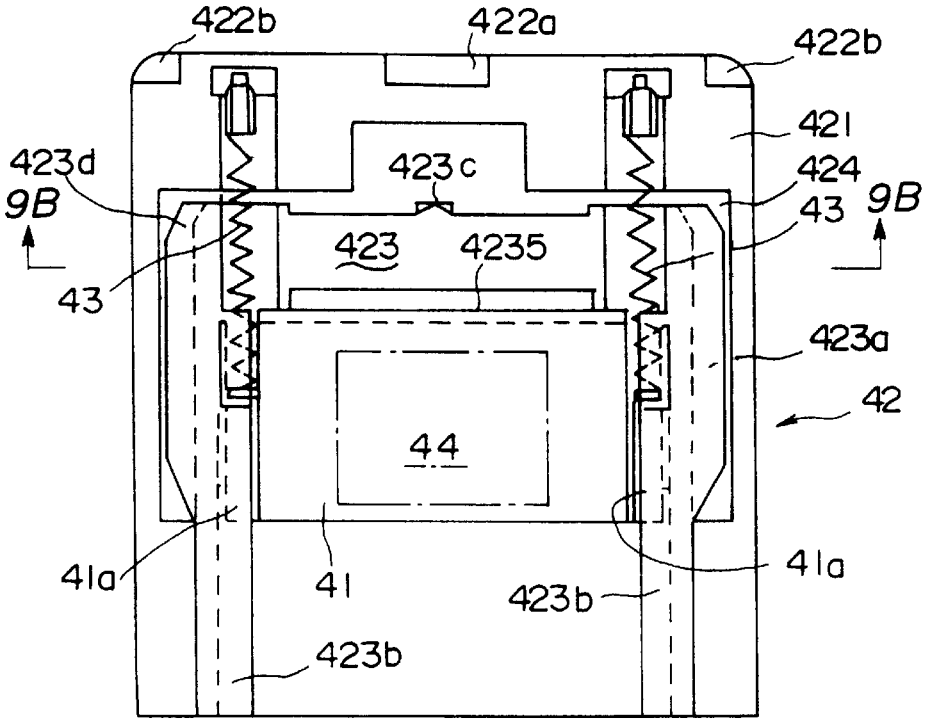
FIG. 8(B) is a top plan view of a shutter member 40 adapted to open and close a toner receiving opening formed in the developer unit.
Figure 8C:
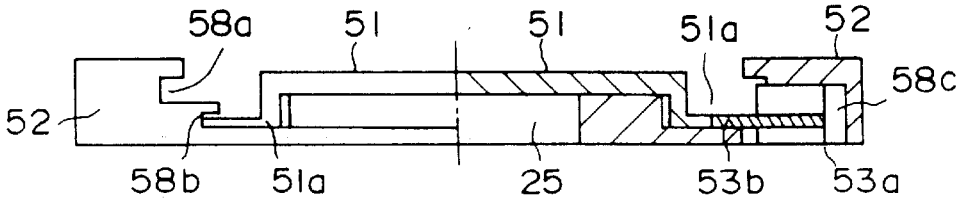
FIG. 8(C) is a sectional view taken along the line 8C—8C in FIG. 8(A)
Figure 10A:
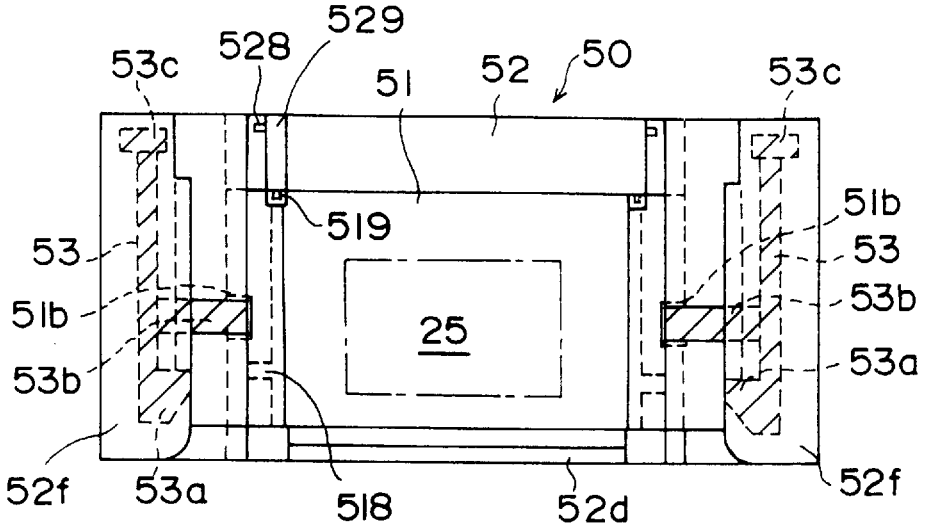
FIG. 10(A) is a plan view of the shutter member 50 as viewed from the developer unit.
Figure 10B:
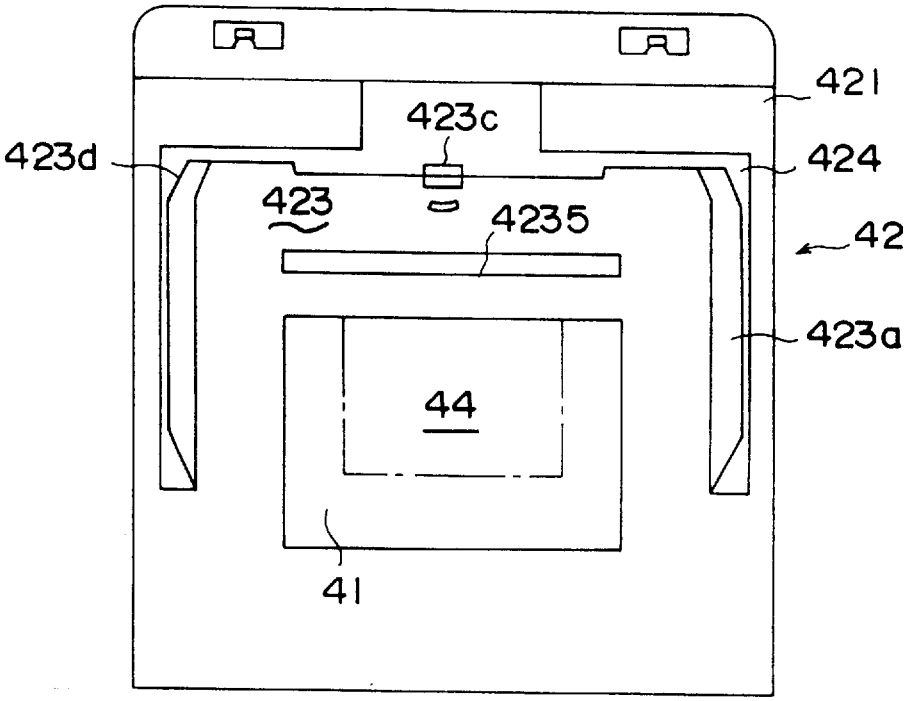
FIG. 10(B) is a plan view of the shutter member 40 as viewed from the developer unit.

FIGS. 8(A) and 8(B) are plane views of the shutter mounting plates 52 and 42 as viewed from above the toner container 2. FIG. 8(C) is a sectional view taken on the line 8C—8C in FIG. 8(A). FIGS. 10(A) and 10(B) are plan views of the shutter mounting plates as viewed from the hopper 12, that is, as seen in a direction opposite to that in FIGS. 8(A) and 8(B).

Specifically, the shutter mounting plate 52 has a pair of restriction grooves 58*b* along which the shutter plate 51 is moved in the transverse direction of the toner container 2. The restriction grooves 58*b* are also adapted to restrict the position of the shutter plate 51 and extend longitudinally of the shutter plate 51. A pair of restriction grooves 58*a* are formed above the restriction grooves 58*b*, and a pair of restriction grooves 58*c* are formed outside of the restriction grooves 58*a* (see FIG. 8(C)). The shutter mounting plate 42 in the developer unit 1 has a guide wall 423*a* which can be fit into the restriction grooves 58*c*. The shutter plate 51 has opposite guide edges 51*a*. The guide edges 51*a* have a L-shaped section and can be fit into the grooves 58*b*.

The shutter mounting plate 52 has a lower or stepped end (FIGS. 10(A) and 10(B)). The stepped end has a central edge 52*d* adapted for engagement with the upper end of the shutter plate 41.

A locking member is provided within the grooves 58*c* to lock the shutter plate 51 in its closed position.

Figure 9A:
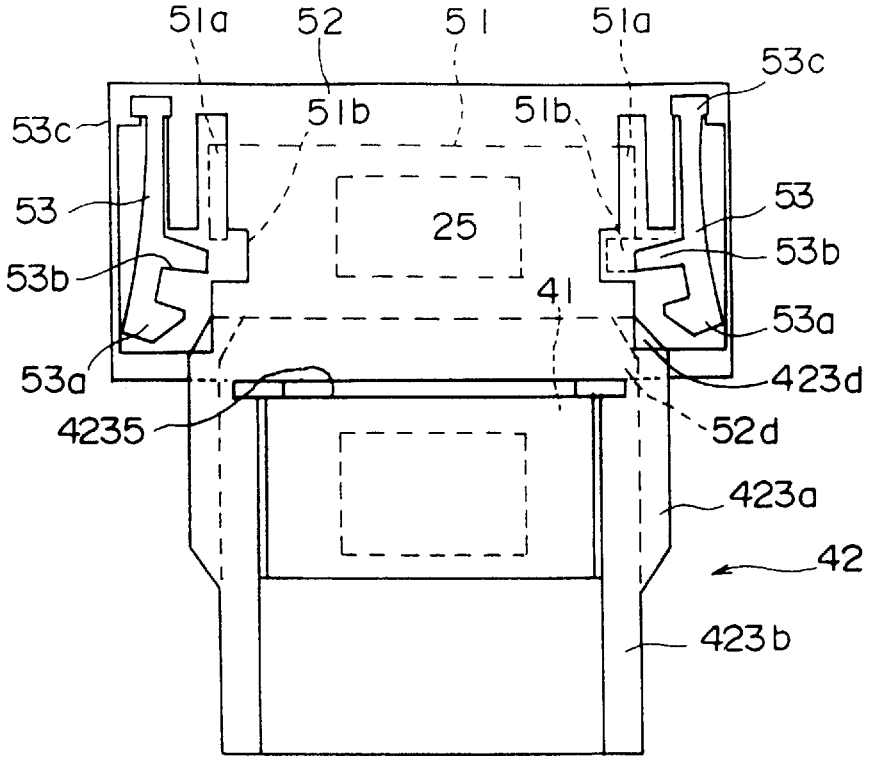
FIG. 9(A) shows the manner in which the toner supply opening is being opened by the shutter member shown in FIG. 8.
Figure 9B:
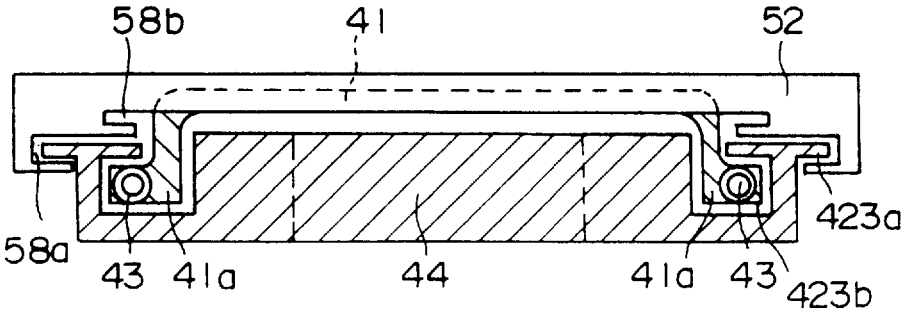
FIG. 9(B) is a sectional view taken along the line 9B—9B in FIG. 8(B) showing the shutter member adapted to open and close the toner receiving opening in the developer unit.

The locking member 53 includes a rectangular proximal end 53*c* fit in the recess of the mounting plate 52. The distal end of the locking member 53 is outwardly swingable about the proximal end 53*c*. A side projection 53*b* (FIG. 9(A)) extends horizontally from the intermediate portion of the locking member 53 toward a rectangular recess 51*b* of the guide edge 51*a* of the shutter plate 51. Also, a wedge portion 53*a* is formed at the distal end of the locking member 53 and is forced to swing outwardly when one end 423*d* of the shutter mounting plate 42 in the developer unit 1 is inserted.

The shutter plate 51 includes a L-shaped guide edge 51*a*, and a recess 51*b* for engagement with the side projection 53*b* of the locking member 53.

In FIG. 10(A), reference numeral 519 indicates a projection extending from the upper end of the shutter plate 51 and adapted to be fit in a recess 529 of the shutter mounting plate 52 and restrict the lower (closed) position of the shutter plate 51.

Reference numeral 528 indicates a projection extending from the upper end of the shutter mounting plate 52 and adapted to be fit in a H-shaped recess of the shutter plate 51 and restrict the upper (open) position of the shutter plate 51.

The shutter member 40 in the developer unit 1 is also made of elastically deformable resin and is received within a mounting hole 451 in the inclined surface 19 through a shaft-like insert 423*c*, as shown in FIG. 4. The shutter member 40 includes a shutter mounting plate 42 in which the toner receiving opening 44 is defined, and a shutter plate 41 adapted to move along a restriction guide 423*b* of the shutter mounting plate 42 in the transverse direction of the toner container so as to open and close the toner receiving opening 44.

The structure of the shutter mounting plate 42 is shown in plan in FIG. 8(B). Specifically, the shutter mounting plate 42 comprises an engagement plate 423, and a swing plate 421 extending around the engagement plate 423 with a generally U-shaped slit 424 therebetween. A pawl 422*a* extends centrally from the front end of the swing plate 421 and is engageable with the upper end of the shutter plate 51 to move down the shutter plate 51 to its closed position. A pair of cams 422*b* are formed at the right and left corners of the front end of the swing plate 421 and adapted to contact with the lower end of the shutter mounting plate 52 so as to retreat the swing plate 421 behind the shutter mounting plate 52.

The engagement plate 423 has the L-shaped side or guide wall 423*a* which is fit into the groove 58*a* formed in the lower end of the shutter mounting plate 52.

A channel 423*b* is formed in the engagement plate 423 in a face-to-face relation to the shutter plate 41 and extends parallel to the L-shaped guide wall 423*a*. The shutter plate 41 has a guide wall 41*a* received in the channel 423*b*. The shutter plate 41 is thus allowed to move in a vertical direction. The shutter plate 41 has opposite projections engaged with springs which are, in turn, engaged with the upper end of the swing plate. This arrangement allows the shutter plate 51 to move in the transverse direction of the toner receiving opening 25.

The toner receiving opening 44 in the engagement plate has a step 4235 at its upper edge, which is engageable with the lower end of the shutter plate 51 in the toner container 2.

Figure 13A:
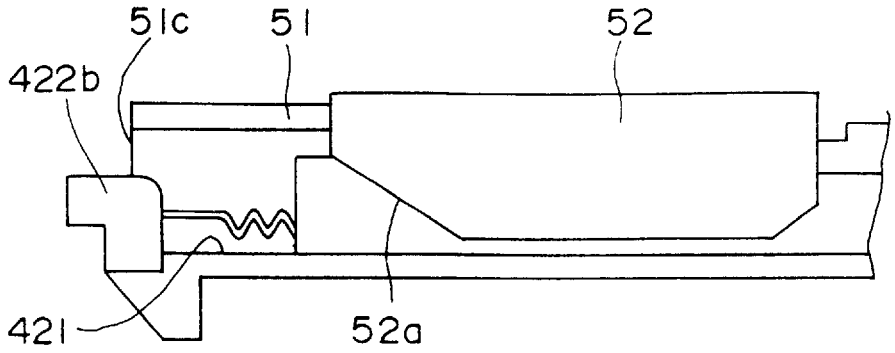
FIGS. 13(A) to 13(C) show the manner in which a shutter mounting plate in the toner container is operated.
Figure 13B:
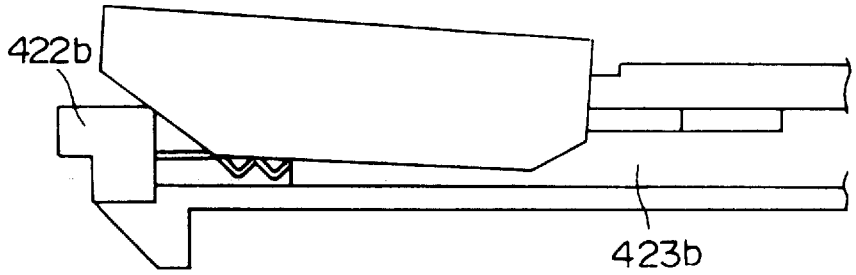
Figure 13C:
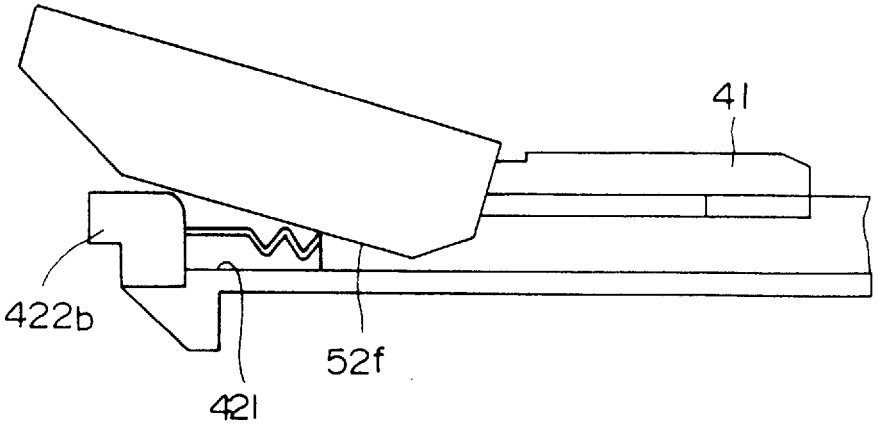

In this embodiment, a lower edge 52*f* (see FIG. 13(C)) of the shutter mounting plate 52 is first brought into contact with the cams 422*b* of the swing plate 421 when the toner container 2 is loaded to the developer unit 1 with the inclined surface 19 aligned with the inclined surface 20*c* of the toner container as shown in FIG. 4. The swing plate 421 is then retreated behind the shutter mounting plate 52. Further movement causes the L-shaped guide wall 423*a* of the engagement plate 423 to be inserted into the groove 58*a* of the shutter mounting plate 52. Further insertion causes the wedge end 53*a* of the locking member 53 to contact with the front corner of the engagement plate 423. This results in displacement of the wedge end 53*a* (see FIG. 9(A)). The side projection 53*b* is disengaged from the recess 51*b* of the shutter plate 51. Thereafter, the lower end of the shutter plate 51 is pressed by the step 4235 of the engagement plate 423 to cause opening of the shutter plate 51.

A step 52*d* of the shutter mounting plate 52 presses the upper end of the shutter plate 41 simultaneously when the shutter plate 51 is opened. The shutter plates 51 and 41 are then moved in such a direction as to open the openings 25 and 44.

When the openings 25 and 44 are completely aligned, the pawl 422*a* comes into engagement with the upper edge 51*c* of the shutter plate 51 (see FIG. 13(A)).

Also, in this embodiment, the shutter mounting plate 52 is fixed to the inclined surface 19 with the insert 423*c* fit into the mounting hole 451. The shutter mounting plate 42 can be slightly swung in a plane parallel to the toner receiving opening 44. As such, the shutter plate 41 can accurately and positively be fixed in its open position even if the pawl 422*a* of the swing 421 and the shutter plate 41 are incorrently assembled or slighly displaced relative to each other.

Moreover, the shutter mounting plate 42 can readily be in close contact when the openings are aligned. This is because the shutter mounting plate 42 is swung in a plane parallel to the opening.

As shown in FIGS. 3(A) and 3(B), pulling of the control lever 15*c* causes disengagement of the pawl 15*a*. The toner container 2 is then moved upwardly along the inclined surface 19 under the action of the spring 43 which pulls the shutter plate 41.

When the shutter mounting plate 52 is moved to the left in FIG. 13(A), the shutter plate 51 closes the opening 25. This is because the shutter plate 51 is engaged with the pawl 422*a* of the swing plate 421.

The shutter plate 41 of the unit 1 which is engaged with the lower end of the shutter mounting plate 52 of the container 2 is moved toward its closed position by the bias of the spring 43 simultaneously when the shutter plate 51 is moved toward its closed position. Then, the swing element of the locking member 53 which is mounted to the shutter mounting plate 52 of the container 2 is disengaged from the front corner 423*d* of the engagement plate 423 and returned to the guide edge 51*a* of the shutter plate 51 under the elastic force of the locking member 53 per se. The side projection 53*b* is moved into engagement with the recess of the guide edge 51*a*. This completes locking of the shutter plate 51.

At this time, an inclined surface 52*a* of the shutter mounting plate 52 is in contact with the cam 422*b* as shown in FIG. 13(B). As shown in FIG. 13(C), the shutter mounting plate 52 is then moved above the cam 422*b* so as to facilitate removal of the toner container 2 from the machine body.

Thereafter, a front end 423*d* of the engagement plate 423 is moved away from the restriction grooves 58*a* of the shutter mounting plate 52 to allow for removal of the toner container 2 from the machine body.

After the toner container 2 has been removed from the machine body, the shutter plate 51 is constantly locked in its closed position by the locking member 53. Since the locking member 53 is not erroneously operated in shipment or handling, the shutter plate 51 will not be inadvertently opened. Moreover, the locking member 53 does not project outside of the unit and is contained on the guide of the shutter member. This also prevents inadvertent opening of the shutter member in shipment or handling.

The locking member 53 is automatically unlocked when the toner container is loaded. This arrangement allows for ready loading of the toner container and prevents the locking member from being kept locked.

Figures 14A, 14B, 14C:
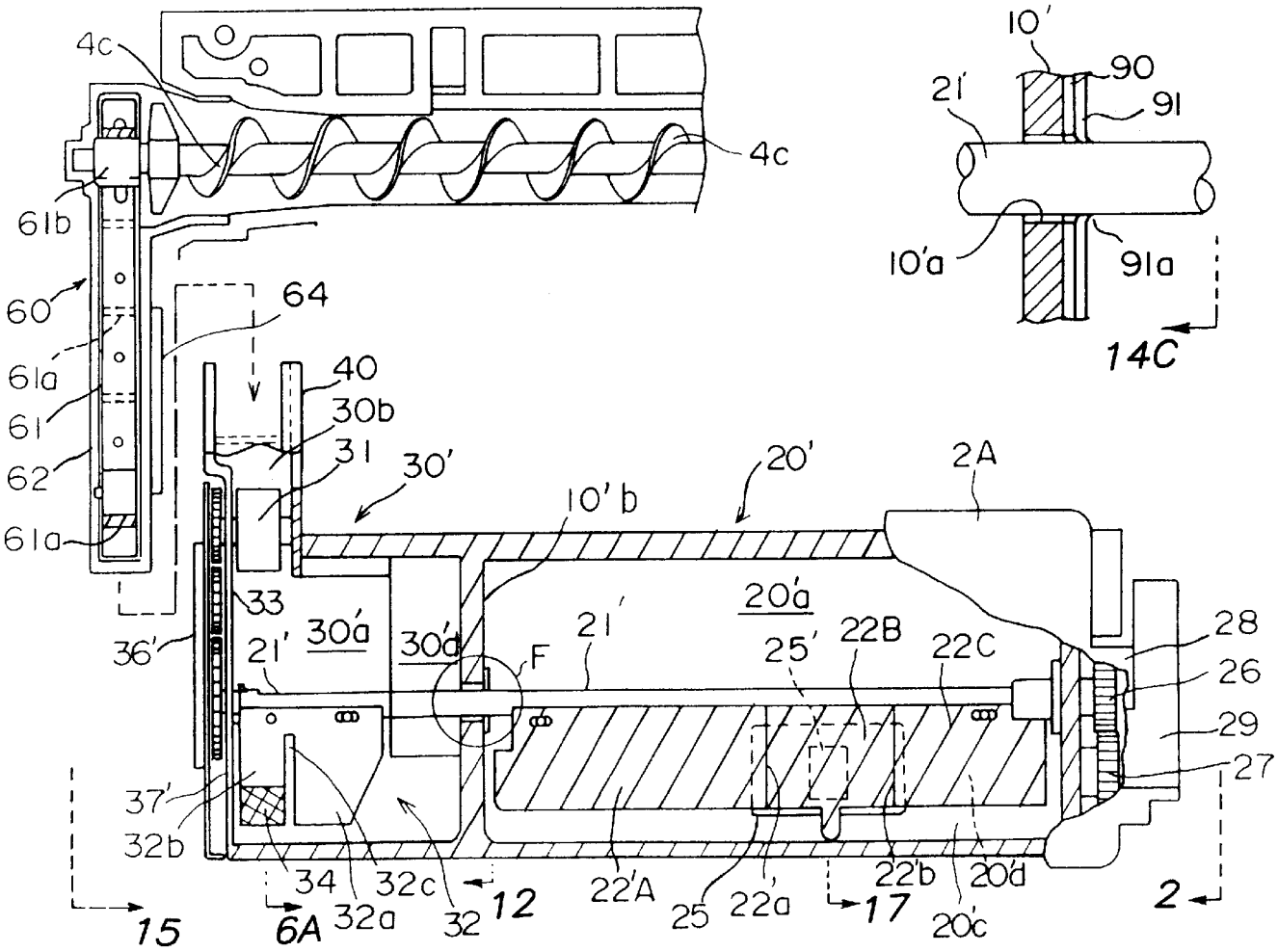
FIG. 14(A) is a plan view of a toner container and a residual toner conveyance mechanism according to a second embodiment of the present invention.
FIG. 14(B) is an enlarged view of the structure as encircled at F in FIG. 14(A)
FIG. 14(C) is an end view taken in the direction 14C in FIG. 14(B)

A second embodiment of the present invention will now be described. FIG. 14(A) is a plan view of a toner container and a residual toner conveyance mechanism according to the second embodiment of the present invention. The difference between the first and second embodiments resides in a seal structure for the rotary shaft 21 with the agitator blade 22 in the partition wall 10 between the residual toner collect section 30 and the toner storage section 20 and the position of the gear train 33 between the rotary shaft 21 and the conveyance roller 31. This structural difference will now be described in detail.

Referring to FIGS. 14(A) and 14(B), a rotary shaft 21' includes an agitation blade 22'. The rotary shaft 21' is rotatably supported in a through hole 10'*a* as encircled at F and shown on an enlarged scale in FIG. 14(B). The opening 10'*a* is defined in a partition wall 10' which is, in turn, located between a toner storage section 20' and a residual toner collect section 30'. A thin film 91 is affixed, by means of a double coated adhesive tape 90, to a wall 10'*b* of the partition wall 10' adjacent to the toner storage section 20'. The film 91 has a central hole in coaxial with the through hole 10'*a*. The central hole of the film 91 is smaller than the outer diameter of the rotary shaft 21' and is in the range of 0.01 to 0.5 mm. An inner edge 91*a* of the central hole advantageously seals the rotary shaft 21' as it is rotated.

Again, the doughnut-shaped film has a central hole in coaxial with the through hole of the partition wall through which the rotary shaft extends. With such a simple seal structure, any residual toner passing through a clearance left between the rotary shaft and the through hole 10'*a* can in no way enter the toner storage section due to the presence of the inner edge 91*a* of the film 91.

The inner edge 91*a* of the film 91 also blocks leakage of fresh toner from the toner storage section 20' into the residual toner collect section 30'.

Referring to FIG. 14, a gear train 33 is mounted to a longitudinal end surface 37' of the toner container so as to transmit rotational force from the rotary shaft 21' to a transfer roller 31.

The gears are coupled to respective rotary shafts or the transfer roller such that the gears may be rotated with the rotary shafts or the transfer roller. For example, each gear has an ellipsoidal hole or a circular hole with a cutout, which are engaged with one ends of each of the shafts. An intermediate gear has a central hole. The rotary shaft extends from the end surface 37' and has one end inserted into the central hole of the intermediate gear. In order to prevent undesirable release of the gears, a gear cover 370 is provided for covering the gear train 33 from the above.

Figure 15A:
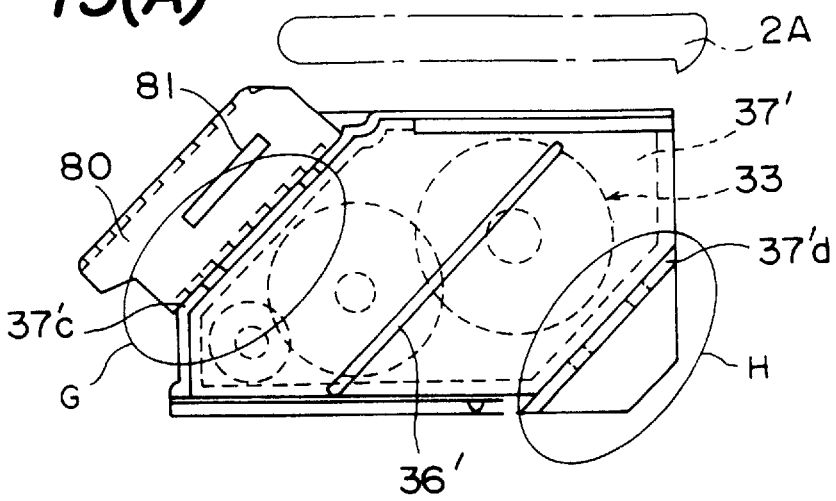
Figure 15A:
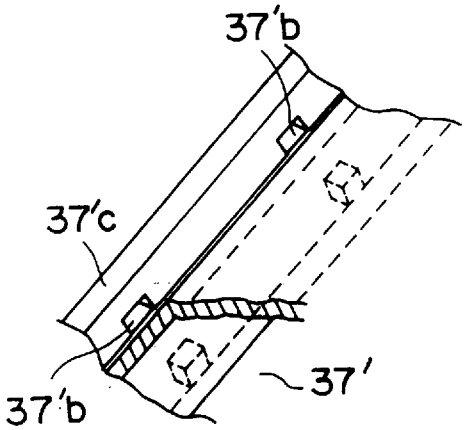
Figure 15A:
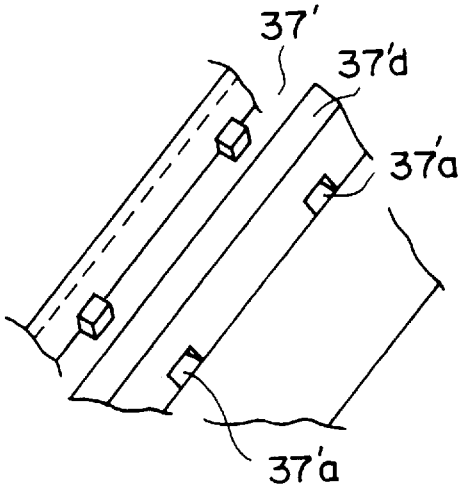
Figure 15C:
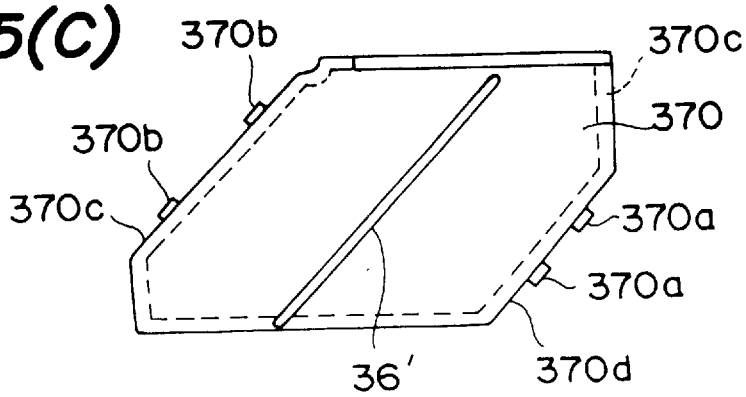

A covering structure is illustrated in FIGS. 15(A) and 15(B)1 and 15(B)2. Specifically, the end surface 37' of the toner container has an inclined flange 37'*c* formed at its upper left-hand corner and an inclined flange 37'*d* extending parallel to the flange 37'*c* and formed in a diagonally opposite relation thereto, that is, formed at its lower right-hand corner. A substantially diamond-shaped space is defined by these flanges 37'*c* and 37'*d*. As shown in FIGS. 15(B)1 and 15(B)2, the flange 37'*c* has two holes 37'*b* and 37'*b*. Similarly, the flange 37'*d* has two holes 37'*a* and 37'*a*.

The gear cover 370 is adapted to cover this diamond-shaped space. A flange depends from the edge of the gear cover 370 and has a height substantially equal to that of each of the flanges 37'*c* and 37'*d*. A position restriction rib 36' extends from the outer surface of the gear cover 370 and is received in a restriction guide groove (not shown) which is, in turn, formed in the machine body. A left flange 370*c* has two projections 370*b* and 370*b* engageable with the corresponding holes 37'*b* and 37'*b*. Similarly, a right flange 370*d* has two projections 370*a* and 370*a* engageable with the corresponding two holes 37'*a* and 37'*a*. In the illustrated embodiment, the gear train is located outside of the residual toner collect section. As such, even if gear teeth are meshed with no clearance, toner will in no way enters between the gear teeth, and no locking results.

Reference will next be made to a sealing structure between a toner container body and a cap according to the second embodiment of the present invention.

Figure 16A:
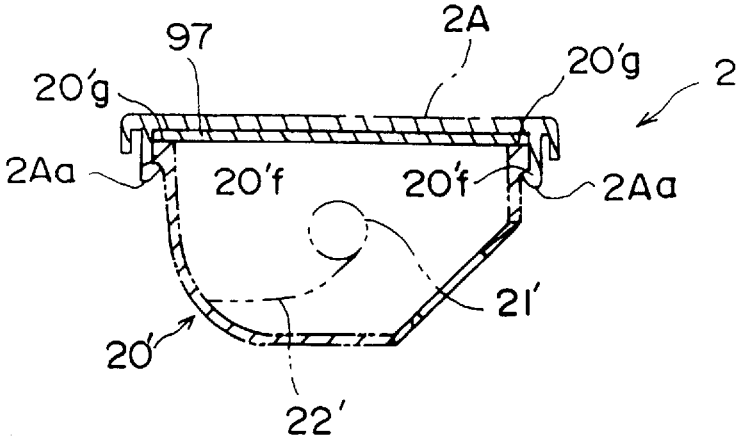
FIG. 16(A) and 16(B) are side and top views of a seal structure between a toner container body and a cap according to the second embodiment of the present invention.
Figure 16B:
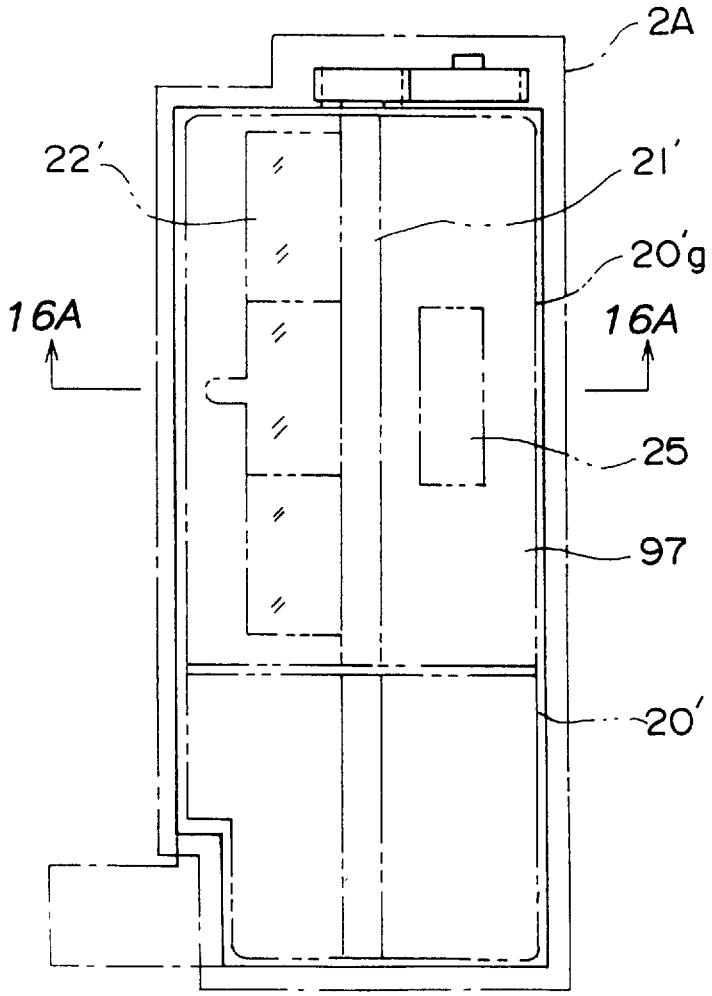

FIG. 16(B) is a top plan view of the toner container body. FIG. 16(A) is a sectional view taken on the line 16A—16A in FIG. 16(B).

A toner container 2 comprises a toner container body 20' made of synthetic resin with calcium carbonate, and a cap 2A similarly made of synthetic resin with calcium carbonate. A resilient sealing member 97 is provided between the toner container body 20' and the cap 2A. The toner container body 20' has an engagement portion 20'*f* adapted for engagement with a pawl 2A*a* of the cap 2A.

The sealing member 97 has an outer configuration substantially identical to the open top of the toner container body 20'. The sealing member 97 is affixed to an upper edge 20'*g* of the toner container body 20' by an adhesive agent or a double coated adhesive tape. When the cap 2A is snap fit over the toner container body 20', the sealing member 97 provides a tight seal between the cap 2A and the upper edge 20'*g* of the toner container body 20'. The sealing member 97 serves to fill any gap which may be formed between the inner surface of the cap 2A and the upper edge 20'*g* of the toner container body 20' as a result of deformation.

Such a simple, but tight seal between the toner container body and the cap eliminates the need for an expensive ultrasonic or oscillation welding equipment.

The toner container 2 is made of synthetic resin with calcium carbonate. This provides low combustion calories, minimizes the generation of toxic gases, and will not deteriorate environment.

The sealing member 97 is made of urethan foam, unwoven fabric, paper, felt and rubber sponge. More preferably, the sealing member is made of PP type sponge as it does not generate toxic gases and odors, and provides better environment.

Reference will now be made to a shutter mounting plate in the machine body according to the second embodiment of the present invention.

Figures 17, 17A:
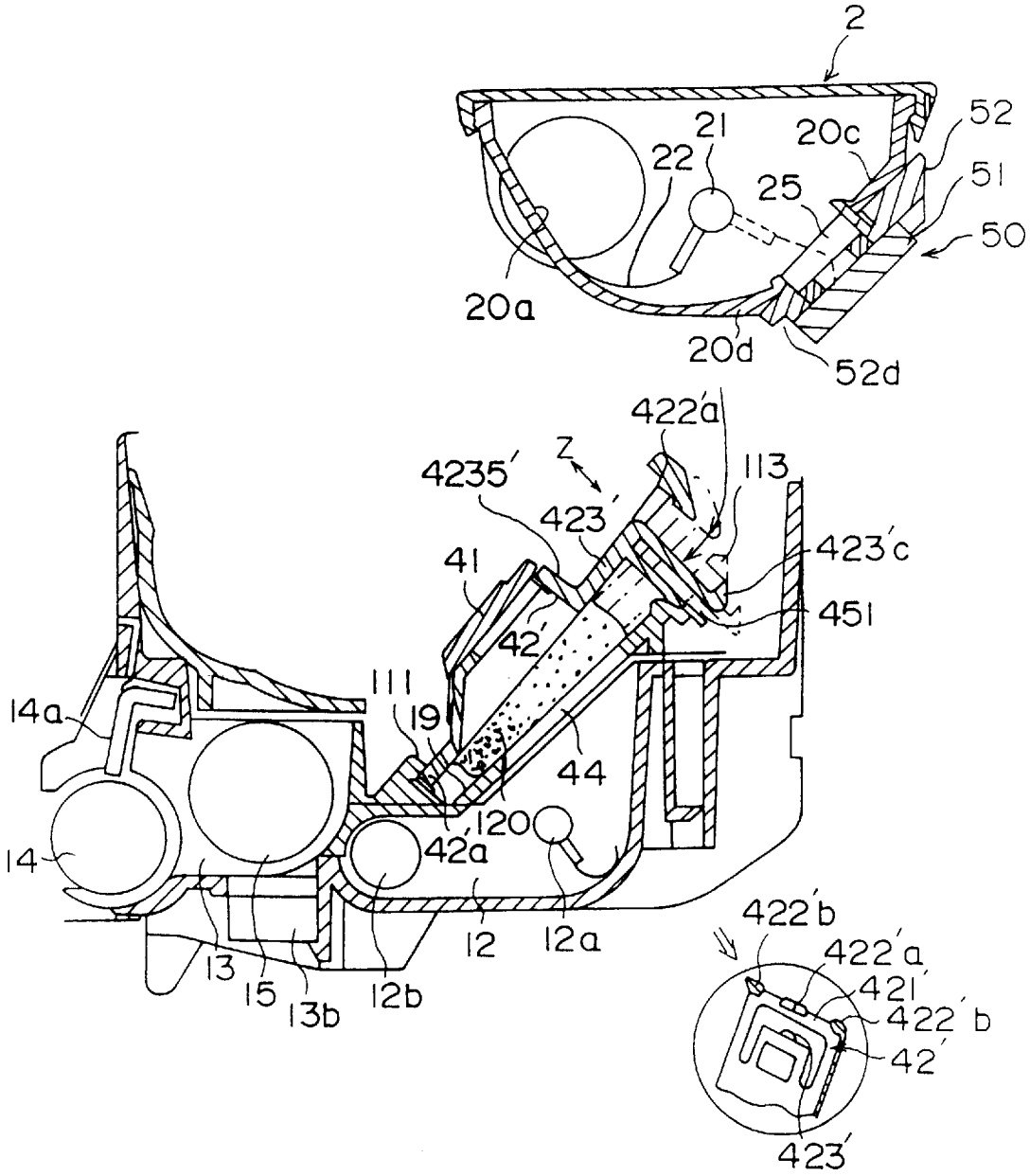
FIG. 17 illustrates the toner container, as seen in the direction of 17 in FIG. 14(A), before it is loaded to or after it is unloaded from the developer unit, with processing means in the phtosensitive drum, toner storage section and shutter mechanism in the developer unit shown in detail.
FIG. 17(A) shows the shutter mechanism in the developer unit of FIG. 17 in detail.
Figure 18:
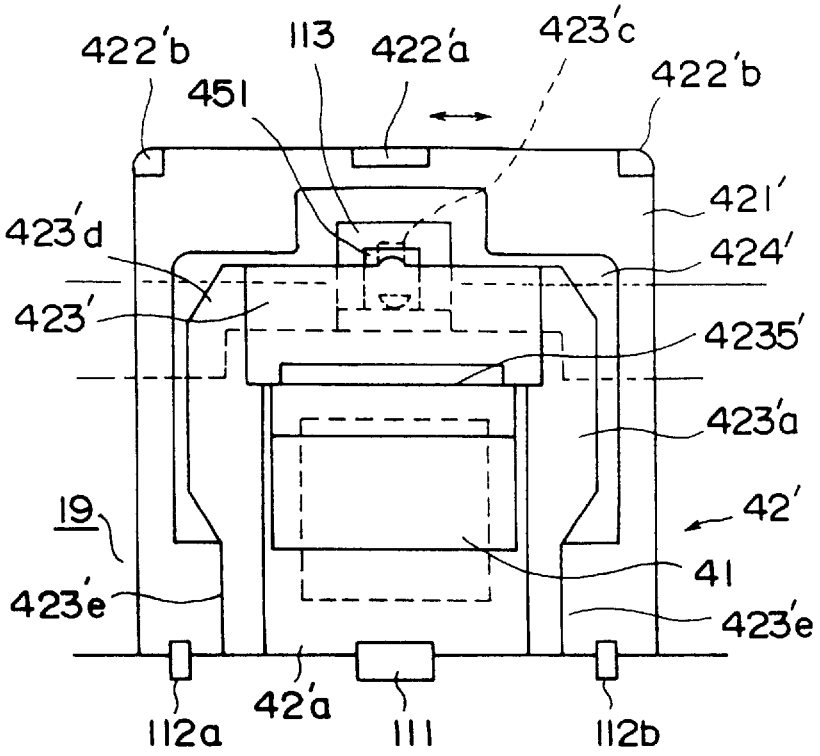
FIG. 18 is a top plan view of a shutter mounting plate in the machine body as seen from the top in FIG. 17.
Figure 19:
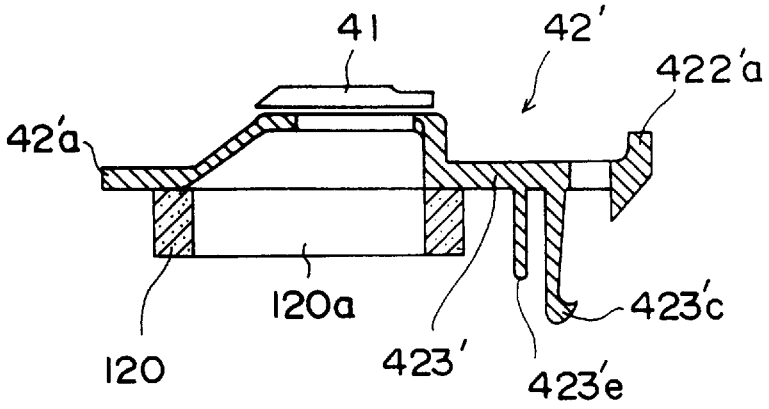
FIG. 19 is a sectional view of the shutter mounting plate in the machine body according to the second embodiment of the present invention.

FIG. 17 is a sectional view of a shutter mounting plate according to the second embodiment of the present invention, with the shutter mounting plate mounted to the machine body. FIG. 18 is a top plan view of the shutter mounting plate as viewed from the top in FIG. 17. FIG. 19 is a sectional view of the shutter mounting plate shown in FIG. 17.

A shutter mounting plate 42' of the second embodiment is different from the shutter mounting plate 42 of the first embodiment in that in the former, inserts 423'*c* and 423'*e* which extend from an engagement plate 423' and are inserted into mounting holes 451 of the machine body are longer than those of the first embodiment, and a cushion member 120 made of urethan sponge, with opening 120*a*, is attached to the toner receiving opening 44, as shown in FIG. 19.

The shutter mounting plate 42' has a lower end 42'*a* for engagement with an engagement portion 111 which is formed in the lower end of the inclined surface 19 of the machine body and faces against the top of the inclined surface 19. An engagement portion 113 is also formed in the upper end of the inclined surface 19 and has the mounting holes 451 into which the inserts 423'*c* and 423'*e* are inserted. By this arrangement, the shutter mounting plate 42' is urged in a direction away from the toner receiving opening 44 under the influence of the cushion member 120 when it is mounted to the machine body, as shown in FIG. 17.

At this time, the cushion member 120 is compressed more strongly at a location adjacent to a step portion 4235' than in a location adjacent to the engagement portion 111. This is because the distance between the engagement plate 423' and a portion of the inclined surface 19 adjacent to the step portion 4235' is greater than that between the engagement plate 423' and a portion of the inclined surface 19 adjacent to the engagement portion 111 as the insert 423'*c* is longer than the insert 42 of the first embodiment.

Accordingly, the upper surface of the engagement plate 423' is not parallel to, but inclined upwardly from the inclined surface 19. Similarly, the shutter plate 41 and a guide wall 423'*a* are both inclined upwardly from the inclined surface 19. This guide wall 423'*a* is inserted into the restriction groove 58*a* which is formed in the shutter mounting plate 52 of the toner container.

The shutter mounting plate 42' is pivotable about the engagement portion 111, and the step portion 4235' is moved toward and away from the inclined surface 19 (in the direction indicated by the double-headed arrow Z). If the shutter mounting plate 52 and the shutter mounting plate 42' are fixed to the toner container and the machine body, respectively, the guide plate would be undesirably forced into the restriction groove. This may result in damage of the mechanism. In this embodiment, the shutter mounting plate 42' is pivoted toward the inclined surface 19 so as to allow gradual or smooth insertion of the guide plate of the shutter mounting plate 42' into the restriction groove in the toner container.

Referring to FIG. 18, a pair of stoppers 112*a* and 112*a* are provided on either side of and spaced a suitable distance away from the engagement portion 111. The stoppers 112*a* and 112*a* are adapted to contact with the guide wall 423'*e* so as to limit lateral movement of the engagement plate 423'. Also, the mounting hole 451 is so formed as to allow lateral movement of the inserts 423'*c*. When the toner container is loaded, the shutter mounting plate 52 can be laterally moved to facilitate positioning of the shutter mounting plate 52 relative to the engagement plate 423'.

Reference will next be made to the manner in which the shutter mounting plate 42' and the shutter mounting plate 52 are operated during loading of the toner container to the machine body.

A position restriction rib 36' and a guide rib 29 are provided on opposite longitudinal ends of the toner container 2.

Referring to FIGS. 20(A) and 20(B), the lower edge 52*f* of the shutter mounting plate 52 is first brought into contact with cams 422'*b* of the shutter mounting plate 42' when the toner container 2 is inserted into the developer unit 1.

The toner container is then lowered while the position restriction rib 36' and the guide rib 29 are guided by the restriction guide grooves in the machine body. As the lower edge 52*f* of the shutter mounting plate 52 causes downward movement of the cams 422'*b*, the shutter mounting plate 42' is lowered against the action of the cushion member 120.

Further downward movement of the toner container 2 causes the shutter mounting plate 42' to move downward as shown in a phantom line. The shutter mounting plate 42' is then engaged with the pawl 15*a* (FIG. 3(A) and 3(B)) of the locking lever 15 as shown in FIG. 20(B). At this time, the shutter mounting plate 42' extends parallel to the inclined surface 19 of the machine body.

As shown in FIG. 18, the guide wall 423'*a* of the shutter mounting plate 42', which is fit in the restriction groove 58*a* of the shutter mounting plate 52 on the toner container 2, has right and left front ends 423'*d* and 423'*d*. These front ends 423'*d* and 423'*d* are obliquely cut to provide a converging end and become shorter between opposite sides of the toner receiving opening 44. As such, the guide wall 423'*a* can be suitably received in the restriction groove 58*a* of the shutter mounting plate 52 even if the shutter mounting plate 52 of the toner container 2 is slightly displaced in a lateral direction.

As mentioned earlier, in this embodiment, the shutter mounting plate 42' in the machine body is moved toward and away from the toner receiving opening 44.

The shutter mounting plate 52 of the toner container 2 and the shutter mounting plate 42' of the machine body tend to be displaced with respect to the restriction groove as a reference due to manufacturing tolerances or assembly errors. If the shutter mounting plates 52 and 42' are both fixed, no positional adjustment can be made. In this embodiment, however, positional adjustment relative to the restriction guide can be effected when the engagement portions of the shutter mounting plates 52 and 42' are too far away from or too close to each other.

Also, the position of the shutter mounting plate 52 relative to the toner supply opening 25 and the position of the shutter mounting plate 42' relative to the opening 44 are subject to displacement in the longitudinal direction of the toner container or the machine body due to manufacturing tolerances or assembly errors. Where the shutter mounting plates 52 and 42' are fixed, their mounting may not smoothly be effected when they are too far away from or too close to each other.

To this end, in this embodiment, the shutter mounting plate 42' can be pivoted in the longitudinal direction of the toner receiving opening 44. This pivotal movement allows for positional adjustment of the shutter mounting plate 42' during mounting of the shutter mounting plates 42' and 52.

Reference will now be made to a seal structure for use in the bearing of a toner agitator blade shaft in the developer unit.

Figure 21A:
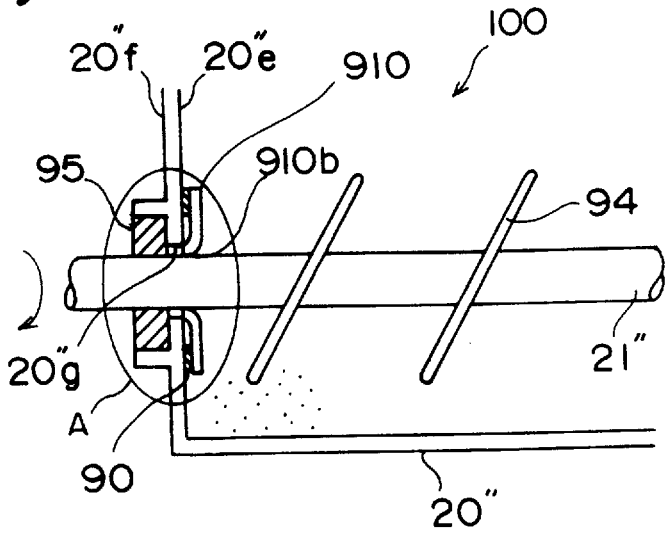
FIG. 21(A) shows a seal structure for a bearing in the developer unit according to the present invention.
Figure 21B:
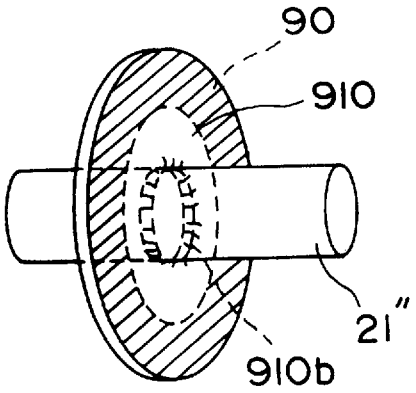
FIG. 21(B) is an enlarged perspective view of the seal structure as encircled at A in FIG. 21(A)
Figure 21C:
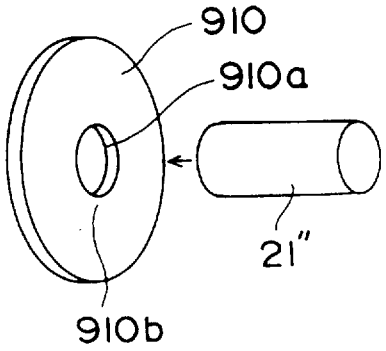
FIG. 21(C) shows the manner in which an agitator shaft is inserted into a seal member.

FIG. 21(A) illustrates a seal structure for use in the bearing of the developer unit according to the present invention. FIG. 21(B) is a perspective view, on an enlarged scale, of the seal structure as encircled at A in FIG. 21(A). FIG. 21(C) illustrates the manner in which an agitator shaft extends through a seal member.

Specifically, the developer unit 100 includes a toner storage unit 20". The toner storage unit 20" has a side wall 20"*f* in which a hole 20"*g* is defined. An agitator shaft 21" has a plurality of fins 94 for agitating a developer material (toner). A bearing 95 has a central hole adapted to receive the agitator shaft 21". The bearing 95 is mounted concentrically within the hole 20"*g*. In order to prevent entry of toner between the agitator blade 21" and the bearing 95, a sealing member 910 is affixed to the inner surface 20"*e* of the side wall by a double coated adhesive tape 90 and is in the form, for example, of a polyester film. The sealing member 910 has an opening 910*a* through which the agitator shaft 21" extends. The opening 910*a* has a diameter smaller than the diameter of the agitator shaft 21". As such, the sealing member 910 is deformed when the agitator shaft extends therethrough. At this time, an inner edge 910*b* of the opening 910 is brought into close contact with the outer surface of the agitator shaft 21" so as to prevent leakage of the toner.

Figure 22A:
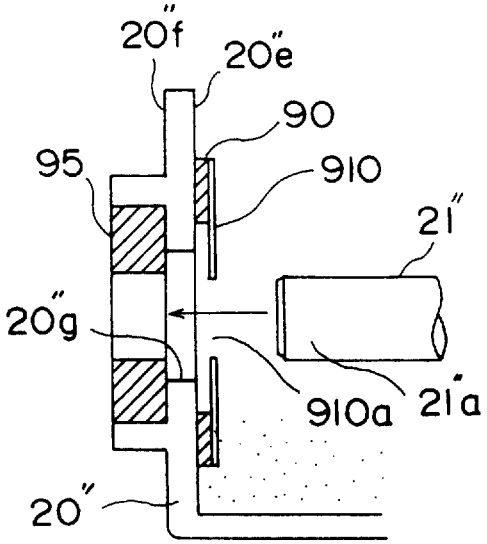
FIGS. 22(A) and 22(B) show the manner in which the agitator shaft is inserted into the seal member.
Figure 22B:
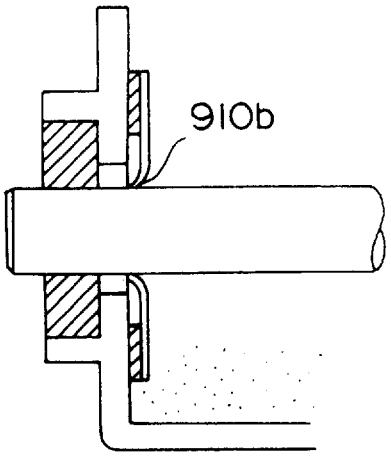

The seal structure will be described in more detail with reference to FIGS. 22(A) and 22(B). The sealing member 910 is affixed to the inner surface 20"*e* of the side wall by the adhesive tape 90 with the central hole of the bearing 95 in concentric with the opening 910*a* of the sealing member 910.

A front end of the agitator shaft 21" is inserted throught the opening 910*a*. At this time, the inner edge 910*b* (FIG. 22(B)) of the sealing member 910 is in close contact with the outer surface of the agitator shaft 21".

Figure 23A:
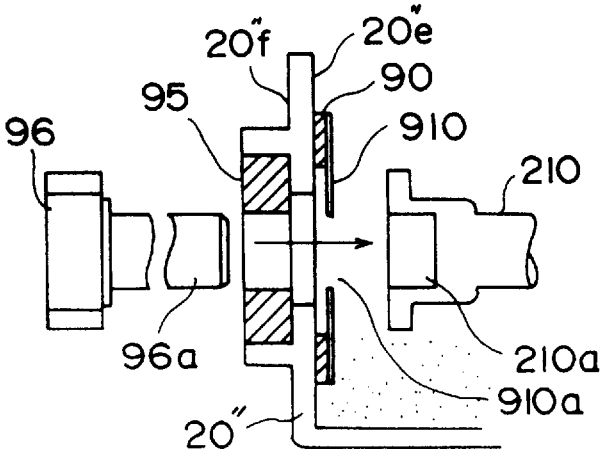
FIGS. 23(A) and 23(B) show a modified form of the seal structure for the bearing.
Figure 23B:
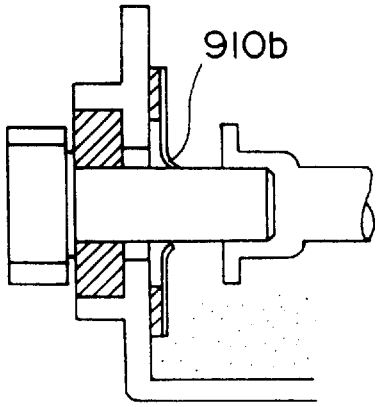

FIGS. 23(A) and 23(B) shows a modified form of the seal structure for use in the bearing. Specifically, the sealing member 910 is affixed to the inner surface 20"*e* of the side wall with the central hole of the bearing 95 in concentric with the opening 910*a* of the sealing member 910.

A gear 96 has a rotary shaft 96*a*. An agitator shaft 210 has a front recess 210*a* at its front end. The rotary shaft 96*a* of the gear 96 is inserted through the opening 910*a* of the sealing member 910 into the recess 210*a* of the agitator shaft 210 within the toner storage section 20".

The inner edge 910*b* of the sealing member 910 is then brought into close contact with the outer surface of the rotary shaft 96*a* as shown in FIG. 23(B).

The difference between the inner diameter of the sealing member and the outer diameter of the agitator shaft is preferably less than 1 mm.

The thickness of the sealing member is preferably in the range from 20$\mu$ to 0.5 mm.

The sealing member is made of elastic materials such as resin, rubber and leather. Preferably, the sealing member is in the form of a polyester or polyethylene film and has a thickness of between 10 and 250$\mu$.

As stated earlier, in this embodiment, the sealing member is in the form of a thin film and has a hole smaller in diameter than the agitator shaft. When the agitator shaft is inserted through the hole of the sealing member, the inner edge of the thin film is so deformed as to closely contact the outer surface of the agitator shaft.

The thin film is deformed by an amount corresponding to the difference between the inner diameter of the thin film and the outer diameter of the shaft. This arrangement allows close contact of the thin film with the shaft.

The agitator shaft is not subject to substantial pressure. No substantial torque is produced as the film is thin. No wear and noise result.

With such a simple structure, but high seal integrity, no toner is accumulated between the bearing and the rotary shaft and escapes from the developer unit.

What is claimed is:

1. A toner storage unit comprising a container, a rotary shaft extending longitudinally of and mounted within the container, and an elastically deformable agitator blade attached to the rotary shaft, the agitator blade being curved with a predetermined radius of curvature and adapted to agitate toner while the agitator blade is frictionally slid on the inner surface of a toner storage section, the toner storage section having a bottom, and a first side wall extending upwardly of and located downstream of the bottom in the direction of rotation of the agitator blade, the first side wall including a toner supply opening, the toner storage section having a second side wall located in opposite relation to the first side wall, the second side wall being curved gradually larger toward the bottom in a transverse section, wherein the rotary shaft has an axis offset toward the toner supply opening.

2. A toner storage unit comprising a container, a rotary shaft extending longitudinally of and mounted within the container, and an elastically deformable agitator blade attached to the rotary shaft, the agitator blade being curved with a predetermined radius of curvature and adapted to agitate toner while the agitator blade is frictionally slid on the inner surface of a toner storage section, the toner storage section having a bottom, and a first side wall extending upwardly of and located downstream of the bottom in the direction of rotation of the agitator blade, the first side wall including a toner supply opening, the toner storage section having a second side wall located in opposite relation to the first side wall, the second side wall being curved gradually larger toward the bottom in a transverse section, wherein the agitator blade has a distal end, the distal end of the agitator blade having a width less than the width of the toner supply opening such that the distal end may enter the toner supply opening when toner is agitated.

3. A toner storage unit comprising a container, a rotary shaft extending longitudinally of and mounted within the container, and an elastically deformable agitator blade attached to the rotary shaft, the agitator blade being curved with a predetermined radius of curvature and adapted to agitate toner while the agitator blade is frictionally slid on the inner surface of a toner storage section, the toner storage section having a bottom, and a first side wall extending upwardly of and located downstream of the bottom in the direction of rotation of the agitator blade, the first side wall including a toner supply opening, the toner storage section having a second side wall located in an opposite relation to the toner supply opening, the walls being such that a portion of the agitator blade at a location from the bottom to the toner supply opening is curved larger than a portion of the agitator blade at a location corresponding to the second side wall, wherein a portion of the container from the bottom to the second side wall has an arcuate surface, or a combination of arcuate and inclined surfaces, the arcuate surface having a center offset from the axis of the rotary shaft toward the second side wall.

4. A toner storage unit comprising a container, a rotary shaft extending longitudinally of and mounted within the container, and an elastically deformable agitator blade attached to the rotary shaft, the agitator blade being curved with a predetermined radius of curvature and adapted to agitate toner while the agitator blade is frictionally slid on the inner surface of a toner storage section, the agitator blade being rotate such that frictional resistance and axial torque applied to the distal end of the agitator blade are displaced in the direction of rotation of the agitator blade, a toner supply opening having a width, in the longitudinal direction of the container, which is less than half the length of the toner storage section, wherein the distal end of the agitator blade has a projection adapted for insertion into an opening, and the opening having a width one eighth to tenth shorter than the length of the toner storage section.

5. A toner storage unit, comprising:

a container, a rotary shaft extending longitudinally from and mounted within the container, a toner storage section having a bottom and an inner surface, an elastically deformable agitator blade attached to the rotary shaft, the agitator blade having a predetermined radius of curvature and being adapted to agitate toner while the agitator blade is frictionally slid on the inner surface of the toner storage section, the toner storage section having a first side wall extending upwardly from and located downstream from the bottom in the direction of rotation of the agitator blade, the first side wall including a toner supply opening, the toner storage section having a second side wall located in opposed relation to the first side wall, the second side wall having a gradually enlarging curve toward the bottom in a transverse section.

6. The toner storage unit of claim 5, wherein the agitator blade comprises synthetic resin with calcium carbonate.

7. A toner storage unit, comprising:

a container, a rotary shaft extending longitudinally from and mounted within the container, a toner storage section having a length, a bottom and an inner surface, an elastically deformable agitator blade attached to the rotary shaft, the agitator blade having a direction of rotation and being curved with a predetermined radius of curvature and adapted to agitate toner while the agitator blade is frictionally slid on the inner surface of a toner storage section, the toner storage section having a first side wall extending upwardly from and located downstream from the bottom in the direction of rotation of the agitator blade, the first side wall including a toner supply opening, the toner storage section having a second side wall located in an opposite relation to the toner supply opening, the walls being such that a first portion of the agitator blade at a location from the bottom to the toner supply opening has a larger curve than a second portion of the agitator blade at a location corresponding to the second side wall.

* * * * *